US008551929B2

(12) United States Patent
Graham et al.

(10) Patent No.: US 8,551,929 B2
(45) Date of Patent: Oct. 8, 2013

(54) UNIT DOSE DETERGENT COMPOSITIONS AND METHODS OF PRODUCTION AND USE THEREOF

(75) Inventors: Troy R. Graham, Milford, CT (US); Anne E. Nixon, Bridgeport, CT (US); Patrick S. A. Harewood, West Haven, CT (US); Narcisse N. Toussa, Westbrook, CT (US); Edison A. Ordoñez, Hamden, CT (US)

(73) Assignee: The Sun Products Corporation, Wilton, CT (US)

( * ) Notice: Subject to any disclaimer, the term of this patent is extended or adjusted under 35 U.S.C. 154(b) by 50 days.

(21) Appl. No.: 13/215,995

(22) Filed: Aug. 23, 2011

(65) Prior Publication Data

US 2012/0108487 A1 May 3, 2012

Related U.S. Application Data

(60) Provisional application No. 61/376,145, filed on Aug. 23, 2010, provisional application No. 61/505,879, filed on Jul. 8, 2011.

(51) Int. Cl.
*C11D 17/00* (2006.01)
*C11D 17/04* (2006.01)

(52) U.S. Cl.
CPC ..... *C11D 17/042* (2013.01)
USPC ..... 510/220; 510/296; 510/439

(58) Field of Classification Search
USPC ..... 510/220, 296, 439
See application file for complete search history.

(56) References Cited

U.S. PATENT DOCUMENTS

| | | | | |
|---|---|---|---|---|
| 5,972,870 | A | 10/1999 | Anderson | |
| 6,376,447 | B1 * | 4/2002 | Boutique et al. | 510/371 |
| 7,125,828 | B2 * | 10/2006 | Catlin et al. | 510/220 |
| 7,479,475 | B2 * | 1/2009 | de Buzzaccarini et al. | 510/293 |
| 2004/0002438 | A1 * | 1/2004 | Hawkins et al. | 510/417 |
| 2005/0065051 | A1 * | 3/2005 | Catlin et al. | 510/220 |
| 2006/0122088 | A1 * | 6/2006 | Sadlowski et al. | 510/295 |
| 2007/0004612 | A1 | 1/2007 | Catlin et al. | |
| 2007/0128129 | A1 * | 6/2007 | Stehr et al. | 424/50 |
| 2007/0241474 | A1 | 10/2007 | Barthel et al. | |
| 2008/0041020 | A1 * | 2/2008 | Alexandre Catlin et al. | 53/452 |
| 2008/0274941 | A1 | 11/2008 | Barthel et al. | |
| 2009/0209447 | A1 | 8/2009 | Meek et al. | |
| 2009/0227484 | A1 | 9/2009 | Preuschen et al. | |
| 2010/0031976 | A1 * | 2/2010 | Warkotsch et al. | 134/25.2 |

OTHER PUBLICATIONS

International Search Report and Written Opinion of the International Searching Authority for International Application No. PCT/US2011/48859, mailed on Jan. 10, 2012, ISA/US, 13 pages.

* cited by examiner

*Primary Examiner* — Gregory Webb
(74) *Attorney, Agent, or Firm* — Stern, Kessler, Goldstein & Fox P.L.L.C.

(57) ABSTRACT

The present invention provides unit dose detergent products, such as those in the form of compositions comprising: a water-soluble single-chamber container, such as a pouch; and a cleaning system comprising at least one detersive surfactant, and optionally one or more additional components. The invention also provides methods of production of such compositions, and methods use of such compositions in processes for cleaning dishware and/or fabrics, including garments, by introducing one or more of the unit dose products of the invention into an automatic washing machine suitable for washing dishware or laundry, whereby the cleaning system is released such that it comes into contact with a soiled article (e.g., dishware or fabrics) under conditions favoring the removal of one or more soils from the article.

34 Claims, 15 Drawing Sheets

UNIT DOSE DETERGENT COMPOSITIONS AND METHODS OF PRODUCTION AND USE THEREOF

CROSS-REFERENCE TO RELATED APPLICATIONS

The present application claims the benefit of the filing dates of U.S. Provisional Application No. 61/376,145, filed Aug. 23, 2010, and U.S. Provisional Application No. 61/505,879, filed Jul. 8, 2011, the contents of which are incorporated herein by reference in their entireties.

BACKGROUND OF THE INVENTION

1. Field of Invention

The present invention is in the fields of household and industrial cleaning, particularly in applications for cleaning of dishware or laundry. More particularly, the present invention provides unit dose detergent products, such as those in the form of compositions comprising: a water-soluble single-chamber container, such as a pouch; and a cleaning system comprising at least one detersive surfactant, and optionally one or more additional components. The invention also provides methods of production of such compositions, and methods use of such compositions in processes for cleaning dishware and/or fabrics, including garments, by introducing one or more of the unit dose products of the invention into an automatic washing machine suitable for washing dishware or laundry, whereby the cleaning system is released such that it comes into contact with a soiled article (e.g., dishware or fabrics) under conditions favoring the removal of one or more soils from the article.

2. Background Art

Unit dose detergent products are often found by consumers to be preferable for use in automatic dishwashing and clothes washing applications. Such unit dose products have several advantages, including convenience of use and dispensing, lower cost per use, and avoiding or minimizing skin contact with potentially irritating cleaning compositions.

Unit dose systems that can be used in automatic dishwashing applications are known in the art. For example, U.S. Pat. No. 7,439,215, discloses unit dose automatic dishwashing compositions enclosed within a multi-chambered water-soluble polymeric film pouch, with one composition (e.g., a powdered detergent composition) contained in one compartment, and a second composition (e.g., a liquid rinse aid) contained in a second compartment separate from (and sealed off from) the first compartment.

Unit dose systems which provide fabric cleaning and fabric softening benefits in the wash cycle of the laundering operation are also known in the art. For example, U.S. Pat. No. 5,972,870 discloses a multi-layered laundry tablet for washing which may include a detergent in the outer layer and a fabric softener, or water softener or fragrance, in the inner layer. Other known unit dose systems involve dual compartments as disclosed in WO 02/08380 where the first compartment contains a detergent composition and the second compartment contains a fabric softening composition.

Other unit-dose cleaning systems contained in multi-compartment water-soluble pouches suitable for use in dishwashing and/or fabric care are disclosed, for example, in U.S. Pat. Nos. 3,218,776; 4,776,455; 6,727,215; 6,878,679; 7,259,134; 7,282,472; 7,304,025; 7,329,441; 7,439,215; 7,464,519; and 7,595,290; the disclosures of which are incorporated herein by reference in their entireties.

The use of multi-compartment systems, such as those described above, however, has several disadvantages. First, the need to produce multiple compartment pouches in which each compartment must be sealed from the others during manufacturing increases the costs and difficulty of manufacturing unit dose products, which often in turn increases the cost of the product to the end user. Moreover, multi-compartment pouches in use are more prone to operational failure, since at least two compartments must dissolve in the aqueous wash liquor in order for the detergent compositions contained within the container to be released to perform their intended purpose of cleaning dishware or fabrics.

Another common problem observed with unit dose systems, particularly those employing a water-soluble polymeric film to produce the pouch or container, is the formulation/compatibility challenge that arises when using a water-soluble film to produce a pouch that is to hold a detergent composition that, in at least one phase, is aqueous-based. Furthermore, it is often difficult to reach composition performance targets which tend to be more difficult to obtain when using a more compacted formulation dose such as that used in most unit dose compositions. Finally, another challenge in producing unit dose detergent products is the issue of visual aesthetics, i.e., the need to make an attractive, self-contained dose. Making a product that performs well, has good compatibility, and also looks good to the consumer are all challenges.

Thus, it would be advantageous to produce a single-compartment unit dose detergent composition that has optimum performance, is economically produced, and is aesthetically pleasing to the end-user. The present invention provides such compositions, as well as methods of producing and using such compositions.

BRIEF SUMMARY OF THE INVENTION

The present invention provides unit dose detergent products, such as those in the form of compositions comprising a water-soluble single-chamber container, such as a pouch; and a cleaning system comprising at least one detersive surfactant, and optionally one or more additional components. The invention also provides methods of production of such compositions, and methods use of such compositions in processes for cleaning dishware and/or fabrics, including garments, by introducing one or more of the unit dose products of the invention into an automatic washing machine suitable for washing dishware or laundry, whereby the cleaning system is released such that it comes into contact with a soiled article (e.g., dishware or fabrics) under conditions favoring the removal of one or more soils from the article.

Thus, in a first aspect, the invention provides multi-phase unit dose detergent compositions, comprising: a water-soluble single-chamber container; and a cleaning system comprising at least two different phases selected from the group consisting of a solid powder phase, a solid gel phase, and a liquid phase, wherein said cleaning system comprises at least one detersive surfactant, wherein said at least two different phases demonstrate little or no visible intermixing at the interphase between said phases. In one such embodiment, the single-chamber container is a formed, sealed pouch produced from a water-soluble polymer or film such as a polyvinylalcohol (PVOH) film.

In certain aspects, the cleaning system comprises a powder phase composition and a gel phase composition, and may further comprise at least one liquid composition. In embodiments comprising at least one powder phase and at least one gel phase, the powder and gel are present in such compositions at a powder/gel ratio selected from 90% powder/10% gel, 86% powder/14% gel, and 82% powder/18% gel, and particularly at a powder/gel ratio of 86% powder/14% gel. In embodiments comprising at least one gel phase, the gel phase composition comprises from about 70% to about 80% (preferably about 76%) dipropylene glycol, from about 10% to about 20% (preferably about 18%) water, and from about 1% to about 10% (preferably about 5%) sodium stearate.

According to certain such aspects of the invention, the powder phase composition comprises said at least one detersive surfactant; and said gel phase composition comprises at least one rinse aid polymer, at least one enzyme, at least one catalyst compound suitable for activating a bleaching system or composition, and the like. In other such aspects of the invention, the powder phase composition comprises at least one detersive surfactant and the gel phase composition comprises at least one fabric conditioning compound or composition.

Detersive surfactants suitable for use in accordance with the prevent invention include, for example, anionic surfactants, nonionic surfactants, zwitterionic surfactants, ampholytic surfactants, cationic surfactants. In certain aspects, the at least one detersive surfactant is an α-sulfo fatty acid salt or ester, such as a methylester sulfonate (MES) of a fatty acid (e.g., palm oil-based MES).

According to certain aspects of the invention, the compositions of the invention are formulated so as to be suitable for use in an automatic dishwashing method for removing soils from dishware.

In other related aspects, the compositions of the invention are formulated so as to be suitable for use in an automatic laundering method for removing soils from fabrics. According to certain such aspects, the automatic laundering method is performed using a washing machine, a tergetometer or an equivalent device.

In related aspects, the present invention provides methods of removing soils from soiled dishware or soiled fabrics.

For example, the invention provides a method of removing soils from soiled dishware, comprising: placing said soiled dishware into the chamber of an automatic dishwashing machine that comprises at least one dosing compartment; placing at least one of the single-compartment unit dose compositions of the present invention into said dosing compartment; and introducing water into the chamber of said machine and washing said dishware in an aqueous environment in said machine under conditions favoring the release of the cleaning system into the chamber of said machine such that the components of said cleaning system contact said dishware and remove said soils from said dishware.

In another aspect, the invention provides a method of removing soils from soiled fabrics, comprising: placing said soiled fabrics into the chamber of an automatic fabric-laundering machine, which may be, for example, a washing machine or a tergetometer, or an equivalent device; placing at least one of the single-compartment unit dose compositions of the invention into said fabric-washing machine; and introducing water into the chamber of said machine and washing said fabrics in an aqueous environment in said machine under conditions favoring the release of the cleaning system into the chamber of said machine such that the components of said cleaning system contact said fabrics and remove said soils from said fabrics. In one such aspect of the invention, the single-compartment unit dose composition is placed into the chamber of said fabric-washing machine prior to introducing water into the chamber of said machine In another such aspect, the single-compartment unit dose composition is placed into the chamber of said fabric-washing machine after introducing water into the chamber of said machine.

Soils that are suitably removed from dishware or fabrics using the compositions and methods of the present invention include, but are not limited to, oil-containing soils, carbohydrate-containing soils, protein-containing soils, tannin-containing soils and particulate soils.

In other aspects, the present invention provides methods for producing multi-phase unit dose detergent compositions, such as those of the present invention. Suitable such methods comprise, for example: producing at least two different phase form compositions selected from the group consisting of a solid powder phase, a solid gel phase, and a liquid phase, wherein at least one of said at least two different phase form compositions comprises at least one detersive surfactant; providing a single-chamber water-soluble container; sequentially layering said at least two different phase form compositions into said container such that said at least two different phases demonstrate little or no visible intermixing at the interphase between said phases; and sealing said container. According to one such aspect of the invention, the single-chamber container is a formed, sealed pouch produced from a water-soluble polymer or film such as PVOH or a PVOH film. In certain such aspects, the methods of the invention allow the production of multi-phase unit dose detergent compositions wherein said at least two different phase form compositions are: at least one powder phase composition and at least one gel phase composition (in which case the multi-phase unit dose detergent composition may further comprise at least one liquid composition); at least one gel phase composition and at least one liquid composition; at least one powder phase composition and at least one liquid composition; and the like. Components that may be suitably contained within the powder phase composition, the solid gel phase composition and/or the liquid phase composition include those described herein, for example for the compositions of the present invention described above. The invention also provides multi-phase unit dose detergent compositions prepared according to such methods, which may be formulated so as to be suitable for use in an automatic dishwashing method for removing soils (such as those soils described above) from dishware or so as to be suitable for use in an automatic laundering method for removing soils (such as those soils described above) from fabrics.

Additional embodiments and advantages of the invention will be set forth in part in the description that follows, and will flow from the description, or may be learned by practice of the invention. The embodiments and advantages of the invention will be realized and attained by means of the elements and combinations particularly pointed out in the appended claim.

It is to be understood that both the foregoing summary and the following detailed description are exemplary and explanatory only and are not restrictive of the invention, as claimed.

BRIEF DESCRIPTION OF THE DRAWINGS

FIGS. 1*a* and 1*b*: exemplary unit dose detergent composition in single-compartment sealed polyvinylalcohol (PVOH) pouch, containing single flat layered gel formulation layered on top of powder formulation, and demonstrating minimal or no penetration of gel layer into powder layer. FIG. 1*b* is a line drawing of FIG. 1*a*.

FIGS. 2*a*-2*d*: exemplary unit dose detergent compositions in single-compartment sealed polyvinylalcohol (PVOH) pouch, containing powder formulation layered on top of single contoured/shaped layered gel, and demonstrating minimal or no penetration of gel layer into powder layer. FIGS. 2*c* and 2*d* are line drawings of FIGS. 2*a* and 2*b*.

FIGS. 3*a* and 3*b*: exemplary unit dose detergent composition in single-compartment sealed polyvinylalcohol (PVOH) pouch, containing single flat layered gel formulation having two colors layered on top of powder formulation. FIG. 3*b* is a line drawing of FIG. 3*a*.

FIGS. 4*a*-4*d*: exemplary unit dose detergent composition in single-compartment sealed polyvinylalcohol (PVOH) pouch, containing powder formulation layered on top of multi-color (in this case, three-color) contoured/shaped layered gel, and demonstrating minimal or no penetration of gel layer into powder layer. FIG. 4*a*: top view of pouch. FIG. 4*b*: side view of pouch.

FIGS. 5*a* and 5*b*: exemplary unit dose detergent composition in single-compartment sealed polyvinylalcohol (PVOH) pouch, containing multiple layers of flat gel and powder (in this case, two alternating layers of each), and demonstrating minimal or no penetration of gel layer into powder layer.

(FIG. 6*a*: top-up; FIG. 6*b*: inverted) containing sequentially layered powder (white solid; bottom layer in FIG. 6*a*, top layer in FIG. 6*b*), gel (lighter solid middle layer in both FIGS. 6*a* and 6*b*) and liquid (dark layer; top layer in FIG. 6*a*, bottom layer in FIG. 6*b*) formulations in a single compartment, demonstrating the production of single-compartment unit dose compositions of the invention containing powder, gel and liquid in separate layers of the single compartment by using the gel layer to separate the powder and liquid layers formulated and layered such that there is minimal or no penetration of the gel and/or liquid formulations into the powder layer.

FIG. 8*a*), in the presence of certain commercially available unit dose dish detergent compositions (FIGS. 8*b*-8*d*), or in the presence of a unit dose dish detergent composition of the present invention (FIG. 8*e*).

DETAILED DESCRIPTION OF THE INVENTION

As used herein, the singular terms "a" and "the" are synonymous and used interchangeably with "one or more" and "at least one," unless the language and/or context clearly indicates otherwise.

As used herein, the term "comprising" means including, made up of and composed of. All numbers in this description indicating amounts, ratios of materials, physical properties of materials and/or use are to be understood as modified by the word "about," except otherwise explicitly indicated.

Overview

The present invention provides unit dose detergent products, which are typically produced in the form of compositions comprising several components: a single-chamber container, such as a pouch, produced of a water-soluble polymer; a cleaning system comprising at least one detersive surfactant; and optionally, one or more additional components. In certain aspects of the invention, the compositions may comprise (a) a single-chamber polyvinylalcohol (PVOH) film pouch, containing (b) a powder detergent composition comprising at least one detersive surfactant; and (c) a gel composition comprising one or more components useful in automatic dishwashing or laundering processes. In related aspects, the present invention also provides methods of production of such compositions, and methods use of such compositions in processes for cleaning dishware and/or fabrics, including garments, by introducing one or more of the unit dose products of the invention into an automatic washing machine suitable for washing dishware or laundry, whereby the cleaning system is released such that it comes into contact with a soiled article (e.g., dishware or fabrics) under conditions favoring the removal of one or more soils from the article.

Figure 5A:
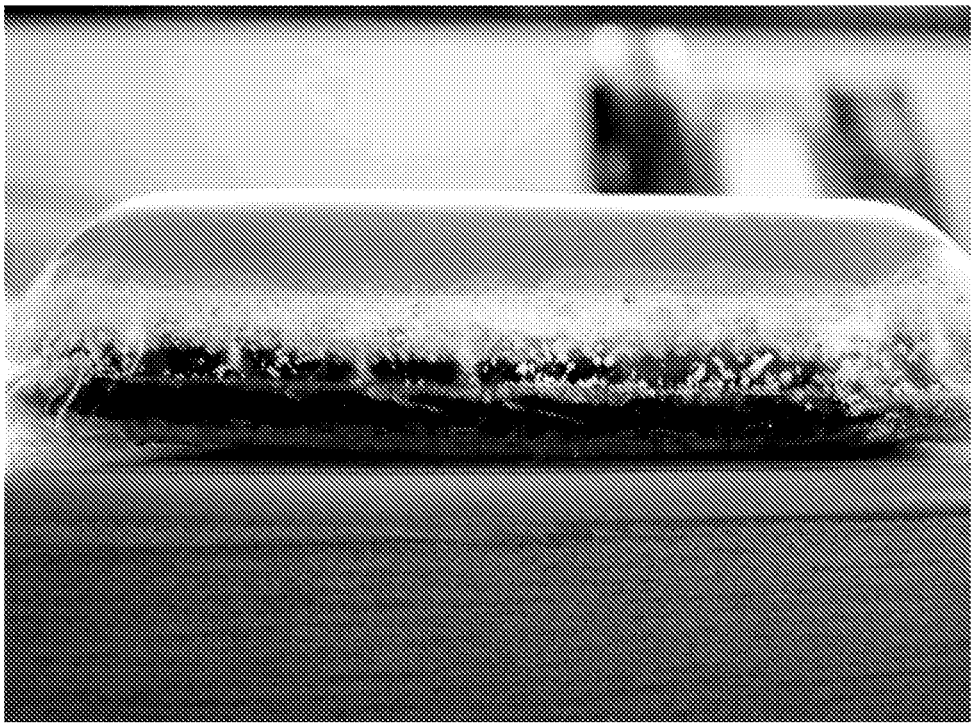
Figure 5B:
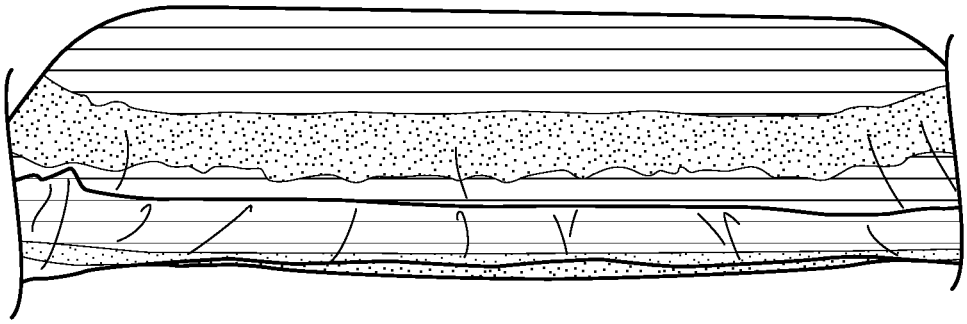
Figure 6A:
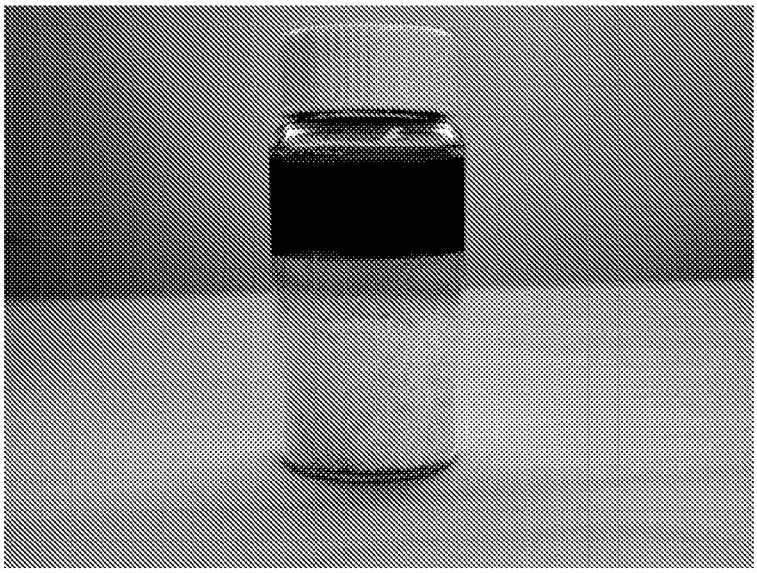
FIGS. 6*a* and 6*b* are each a photograph of a sealed glass container
Figure 6B:
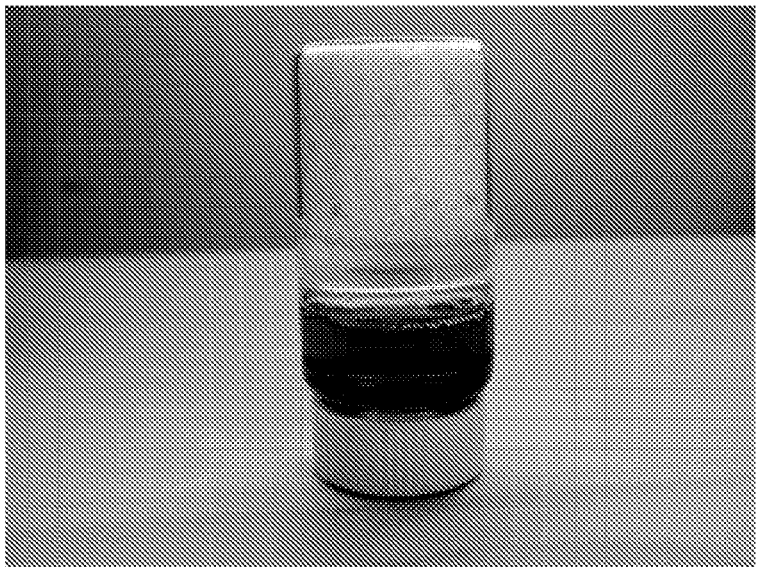
Figure 6C:
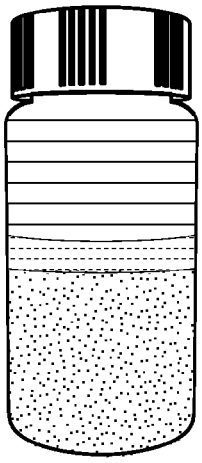
FIGS. 6*c* and 6*d* are respective black & white line renderings of the photographs of FIGS. 6*a* and 6*b*.
Figure 6D:
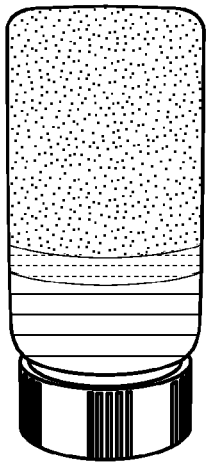
Figure 7A:
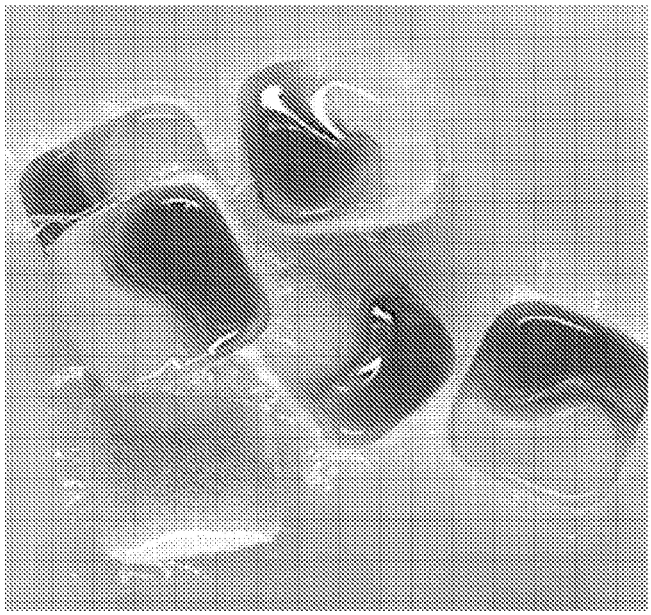
FIGS. 7*a* and 7*b* are photographs of exemplary unit dose detergent compositions in single-compartment PVOH pouches, showing a variety of color and shape combinations suitably used with the present compositions.
Figure 7B:
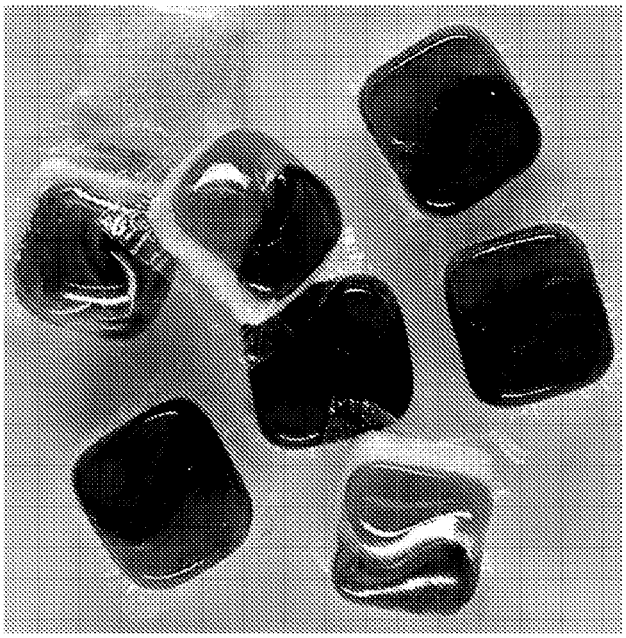
Figure 7C:
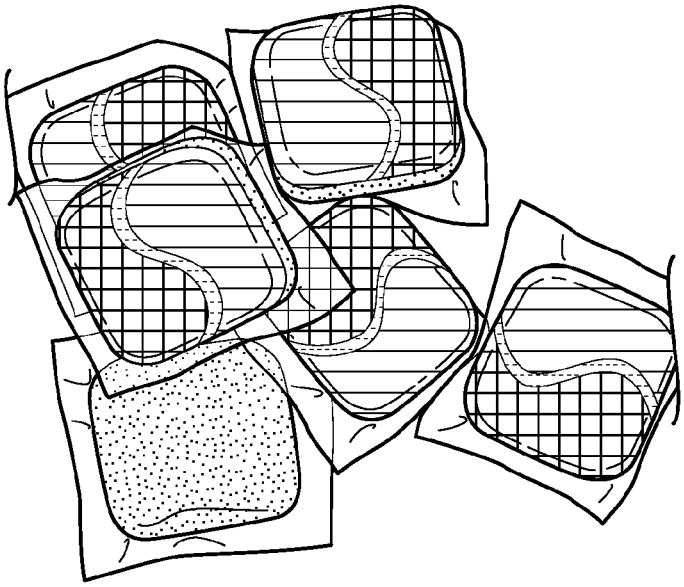
FIGS. 7*c* and 7*d* are respective black & white line renderings of FIGS. 7*a* and 7*b*.
Figure 7D:
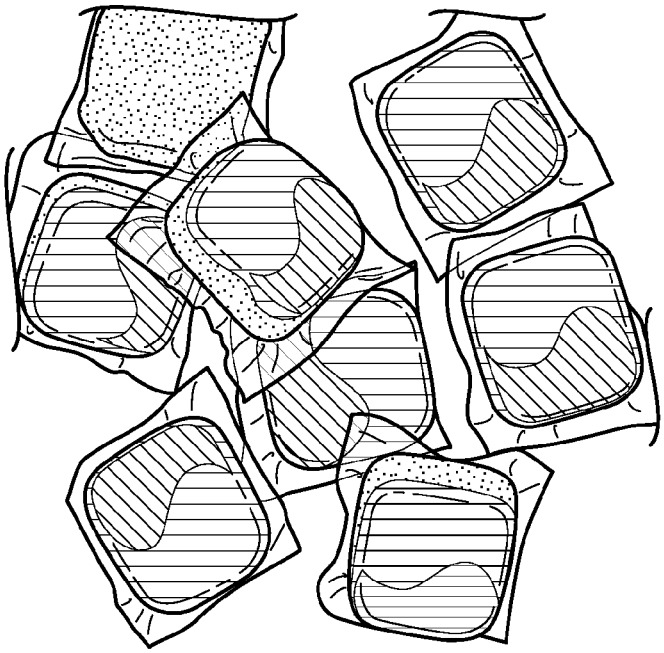

In general, the compositions of the present invention are produced by placing at least two (i.e., two, three, four, five, six, etc.) layers of at least two states of matter (e.g., a powder, gel and/or liquid) into direct contact with each other in a single-compartment water-soluble container (e.g., a pouch produced of a water-soluble polymer such as polyvinyl alcohol (PVOH)), instead of separating each state of matter into a different compartment sealed from the other compartments containing other states of matter in art-known multiple compartment compositions. As described in further detail herein, this is done by using a powder and combining it, in a separate layer, with a gel that has a very high viscosity at room temperature such that it does not innately mix with the powder present in the same compartment of the container. According to this aspect of the invention, the gel is a liquid upon heating such that it can be filled into the container (e.g., pouch), and exhibits hysteresis so it does not freeze immediately when cooled to a temperature below its melting point. This phenomenon, which depends critically upon the formulation used to produce the gel, allows for a process to build the unit dose compositions of the present invention within a controlled temperature range by freezing the liquid gel upon contact with a surface during manufacturing. This approach results in the production of unit dose detergent compositions that provide both the aesthetic perception of multi-functionality and the reasonable goal of multi-functionality upon formulation optimization. As also described herein, the compositions of the invention may have multiple alternating layers of powder and gel, or of powder, gel and liquid, with the caveat that a gel layer must be present between a powder layer and a liquid layer if powder and liquid are to be used in producing the unit dose compositions of the invention. Examples of such multi-layered compositions are shown in FIG. 5*a* and FIGS. 6*a* and 6*b*.

The process of using, filling, and cooling the gel are unique and inherent to successfully creating the compositions of the present invention. In certain embodiments, the invention relies at least in part on the fact that a liquid and powder can be combined in a single pouch with minimal migration, by ensuring that the liquid forming the gel instantly freezes upon contact with a cool surface such as the powder or the cavity depending on fill order (both options have been practiced). However, in order for the gel to be processed realistically, it needs to have a range of low viscosity where it can be used before freezing, which can clog the pump, nozzles, etc. of the processing machinery being used to produce the finished compositions. In certain embodiments (as shown in the Examples herein, for instance), the principle of hysteresis applies to the liquid-gel formula—it has a higher melting point than freezing point, in that it can be melted to 160° F. in order to be pumped and filled, but does not freeze until about 140° F. so it can tolerate some minor cooling from ambient air and equipment before freezing. Ideally, the gel is filled at about 145° F. to about 155° F., or at about 149° F.-150° F. Where it will still be a liquid during fill, but will not migrate into the powder as it freezes instantly upon coming in contact with the powder or cavity which would typically be in the temperature range of about 70° F.-100° F.

The filling process used to produce the single-compartment unit dose compositions of the present invention uses less film than art-known multi-compartment unit dose products, since only two layers of film (top and bottom; nothing in-between) are used in the present compositions to make a single compartment even though multiple physical phases of different compositions exist within this single compartment. Moreover, because the two layers of film are sealed to produce the container used in the present invention, the manufacturing process is easier and more economical than that used for producing art-known multi-compartment unit dose products, since the methods used to produce the compositions of the present invention do not involve the process of fusing multiple compartments together or creating physical dividers with the film, as is required for producing art-known multi-compartment unit dose products.

Thus, in a first aspect, the invention provides multi-phase unit dose detergent compositions, comprising: a water-soluble single-chamber container; and a cleaning system comprising at least two different phases selected from the group consisting of a solid powder phase, a solid gel phase, and a liquid phase, wherein said cleaning system comprises at least one detersive surfactant, wherein said at least two different phases demonstrate little or no visible intermixing at the interphase between said phases. In one such embodiment, the single-chamber container is a formed, sealed pouch produced from a water-soluble polymer or film such as a polyvinylalcohol (PVOH) film.

The cleaning system used herein, and preferably the powder component of the cleaning system, comprises at least one detersive surfactant (also referred to herein as a detergent). Suitable classes of detersive surfactants for use in the compositions of the present invention include anionic surfactants, nonionic surfactants, zwitterionic surfactants, ampholytic surfactants, cationic surfactants, and the like, examples of which are known in the art and/or are described herein.

In certain aspects, the at least one detersive surfactant is an alkylene sulfofatty acid salt (also referred to herein as an α-sulfofatty acid ester), such as a methylester sulfonate (MES) of a fatty acid (e.g., palm oil-based MES). Such a sulfofatty acid is typically formed by esterifying a carboxylic acid with an alkanol and then sulfonating the α-position of the resulting ester. The α-sulfofatty acid ester is typically of the following formula (I):

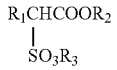

(I)

wherein $R_1$ is a linear or branched alkane, $R_2$ is a linear or branched alkane, and $R_3$ is hydrogen, a halogen, a monovalent or di-valent cation, or an unsubstituted or substituted ammonium cation. $R_1$ can be a $C_4$ to $C_{24}$ alkane, including a $C_{10}$, $C_{12}$, $C_{14}$, $C_{16}$ and/or $C_{18}$ alkane. $R_2$ can be a $C_1$ to $C_8$ alkane, including a methyl group. $R_3$ is typically a monovalent or di-valent cation, such as a cation that forms a water soluble salt with the α-sulfofatty acid ester (e.g., an alkali metal salt such as sodium, potassium or lithium). The α-sulfofatty acid ester of formula (I) can be a methyl ester sulfonate, such as a $C_{16}$ methyl ester sulfonate, a $C_{18}$ methyl ester sulfonate, or a mixture thereof.

More typically, the α-sulfofatty acid ester is a salt, which is generally of the following formula (II):

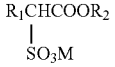

(II)

wherein $R_1$ and $R_2$ are alkanes and M is a monovalent metal. For example, $R_1$ can be an alkane containing 4 to 24 carbon atoms, and is typically a $C_8$, $C_{10}$, $C_{12}$, $C_{14}$, $C_{16}$ and/or $C_{18}$ alkane. $R_2$ is typically an alkane containing 1 to 8 carbon atoms, and more typically a methyl group. M is typically an alkali metal, such as sodium or potassium. The α-sulfofatty acid ester of formula (II) can be a sodium methyl ester sulfonate, such as a sodium $C_8$-$C_{18}$ methyl ester sulfonate.

In one embodiment, the composition comprises at least one α-sulfofatty acid ester. For example, the α-sulfofatty acid ester can be a $C_{10}$, $C_{12}$, $C_{14}$, $C_{16}$ or $C_{18}$ α-sulfofatty acid ester. In another embodiment, the α-sulfofatty acid ester comprises a mixture of sulfofatty acids. For example, the composition can comprise a mixture of α-sulfofatty acid esters, such as $C_{10}$, $C_{12}$, $C_{14}$, $C_{16}$ and $C_{18}$ sulfofatty acids. The proportions of different chain lengths in the mixture are selected according to the properties of the α-sulfofatty acid esters. For example, $C_{16}$ and $C_{18}$ sulfofatty acids (e.g., from tallow and/or palm stearin MES) generally provide better surface active agent properties, but are less soluble in aqueous solutions. $C_{10}$, $C_{12}$ and $C_{14}$ α-sulfofatty acid esters (e.g., from palm kernel oil or coconut oil) are more soluble in water, but have lesser surface active agent properties. Suitable mixtures include $C_8$, $C_{10}$, $C_{12}$ and/or $C_{14}$ α-sulfofatty acid esters with $C_{16}$ and/or $C_{18}$ α-sulfofatty acid esters. For example, about 1 to about 99 percent of $C_8$, $C_{10}$, $C_{12}$ and/or $C_{14}$ α-sulfofatty acid ester can be combined with about 99 to about 1 weight percent of $C_{16}$ and/or $C_{18}$ α-sulfofatty acid ester. In another embodiment, the mixture comprises about 1 to about 99 weight percent of a $C_{16}$ or $C_{18}$ α-sulfofatty acid ester and about 99 to about 1 weight percent of a $C_{16}$ or $C_{18}$ α-sulfofatty acid ester. In yet another embodiment, the α-sulfofatty acid ester is a mixture of $C_{18}$ methyl ester sulfonate and a $C_{16}$ methyl ester sulfonate and having a ratio of about 2:1 to about 1:3.

The composition can also be enriched for certain α-sulfofatty acid esters, as disclosed in co-pending U.S. Pat. No. 6,683,039, to provide the desired surfactant properties. The disclosure of that application is incorporated by reference herein. For example, α-sulfofatty acid esters prepared from natural sources, such as palm kernel (stearin) oil, palm kernel (olein) oil, or beef tallow, are enriched for $C_{16}$ and/or $C_{18}$ α-sulfofatty acid esters by addition of the purified or semi-purified α-sulfofatty acid esters to a mixture of α-sulfofatty acid esters. Suitable ratios for enrichment range from greater than 0.5:1, about 1:1, about 1.5:1, to greater than 2:1, and up to about 5 to about 6:1, or more, of $C_{16}$-$C_{18}$ to other chain length α-sulfofatty acid esters. An enriched mixture can also comprise about 50 to about 60 weight percent $C_8$-$C_{18}$ α-sulfofatty acid esters and about 40 to about 50 weight percent $C_{16}$ α-sulfofatty acid ester.

Methods of preparing α-sulfofatty acid esters are known to the skilled artisan. (See, e.g., U.S. Pat. Nos. 5,587,500; 5,384,422; 5,382,677; 5,329,030; 4,816,188; and 4,671,900; the disclosures of which are incorporated herein by reference.) α-Sulfofatty acid esters can be prepared from a variety of sources, including beef tallow, palm kernel oil, palm kernel (olein) oil, palm kernel (stearin) oil, coconut oil, soybean oil, canola oil, cohune oil, coco butter, palm oil, white grease, cottonseed oil, corn oil, rape seed oil, soybean oil, yellow grease, mixtures thereof or fractions thereof. Other sources of fatty acids to make α-sulfofatty acid esters include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. α-Sulfofatty acid esters prepared from one or more of these sources are within the scope of the present invention.

The compositions according to the present invention comprise an effective amount of α-sulfofatty acid ester (i.e., an amount which exhibits the desired cleaning and surfactant properties). In one embodiment, an effective amount is at least about 0.5 weight percent α-sulfofatty acid ester. In another embodiment, the effective amount is at least about 1 weight percent α-sulfofatty acid ester. In another embodiment, an effective amount is at least about 5 weight percent α-sulfofatty acid ester. In still another embodiment, an effective amount of the α-sulfofatty acid ester is at least about 10 weight percent, at least about 25 weight percent, or at least about 30 weight percent. In another embodiment, an effective amount is from 0.5 weight percent to 30 weight percent α-sulfofatty acid ester, preferably from 0.5 weight percent to 25 weight percent, or from 1 weight percent to 25 weight percent, or from 1 weight percent to 10 weight percent, or from 5 weight percent to 10 weight percent. These weight percentages are based on the total weight of the composition.

Other detersive surfactants suitable for use in preparing the present compositions include additional anionic surfactants, nonionic surfactants, zwitterionic surfactants, ampholytic surfactants, cationic surfactants. Suitable nonionic surfactants include polyalkoxylated alkanolamides, which are generally of the following formula (III):

$$R_4\overset{\overset{\displaystyle O}{\|}}{C}NR_6R_5(OR_7)_nH \qquad \text{(III)}$$

wherein $R_4$ is an alkane or hydroalkane, $R_5$ and $R_7$ are alkanes and n is a positive integer. $R_4$ is typically an alkane containing 6 to 22 carbon atoms. $R_5$ is typically an alkane containing 1-8 carbon atoms. $R_7$ is typically an alkane containing 1 to 4 carbon atoms, and more typically an ethyl group. The degree of polyalkoxylation (the molar ratio of the oxyalkyl groups per mole of alkanolamide) typically ranges from about 1 to about 100, or from about 3 to about 8, or about 5 to about 6. $R_6$ can be hydrogen, an alkane, a hydroalkane group or a polyalkoxylated alkane. The polyalkoxylated alkanolamide is typically a polyalkoxylated mono- or di-alkanolamide, such as a $C_{16}$ and/or $C_{18}$ ethoxylated monoalkanolamide, or an ethoxylated monoalkanolamide prepared from palm kernel oil or coconut oil.

Methods of manufacturing polyalkoxylated alkanolamides are known to the skilled artisan. (See, e.g., U.S. Pat. Nos. 6,034,257 and 6,034,257, the disclosure of which are incorporated by reference herein.) Sources of fatty acids for the preparation of alkanolamides include beef tallow, palm kernel (stearin or olein) oil, coconut oil, soybean oil, canola oil, cohune oil, palm oil, white grease, cottonseed oil, mixtures thereof and fractions thereof. Other sources include caprylic ($C_8$), capric ($C_{10}$), lauric ($C_{12}$), myristic ($C_{14}$), myristoleic ($C_{14}$), palmitic ($C_{16}$), palmitoleic ($C_{16}$), stearic ($C_{18}$), oleic ($C_{18}$), linoleic ($C_{18}$), linolenic ($C_{18}$), ricinoleic ($C_{18}$), arachidic ($C_{20}$), gadolic ($C_{20}$), behenic ($C_{22}$) and erucic ($C_{22}$) fatty acids. Polyalkoxylated alkanolamides from one or more of these sources are within the scope of the present invention.

The compositions can also an effective amount of polyalkoxylated alkanolamide (e.g., an amount which exhibits the desired surfactant properties). In some applications, the composition contains about 1 to about 10 weight percent of a polyalkoxylated alkanolamide. For example, the composition can comprise at least about one weight percent of polyalkoxylated alkanolamide.

Other suitable nonionic surfactants include those containing an organic hydrophobic group and a hydrophilic group that is a reaction product of a solubilizing group (such as a carboxylate, hydroxyl, amido or amino group) with an alkylating agent, such as ethylene oxide, propylene oxide, or a polyhydration product thereof (such as polyethylene glycol). Such nonionic surfactants include, for example, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides. Other suitable surfactants include those disclosed in U.S. Pat. Nos. 5,945,394 and 6,046,149, the disclosures of which are incorporated herein by reference. In another embodiment, the composition is substantially free of nonylphenol nonionic surfactants. In this context, the term "substantially free" means less than about one weight percent.

Polymer dispersants, such as polymers and co-polymers of acrylic acid, methacrylic acid, maleic acid, fumaric acid, itaconic acid, and water-soluble salts thereof, such as alkali metal, ammonium, or substituted ammonium salts, can optionally be included in the composition. Suitable polymer dispersants further include those sold under the trade names ACUSOL® 445 (polyacrylic acid), ACUSOL® 445N (polyacrylic acid sodium salt), ACUSOL® 460N (a maleic acid/olefin copolymer sodium salt), and ACUSOL® 820 (acrylic copolymer), sold by Rohm and Haas Company.

In an embodiment, a secondary anionic surfactant is included in the composition. Suitable secondary anionic surfactants includes those surfactants that contain a long chain hydrocarbon hydrophobic group in their molecular structure and a hydrophilic group, i.e., water solubilizing group including salts such as carboxylate, sulfonate, sulfate or phosphate groups. Suitable anionic surfactant salts include sodium, potassium, calcium, magnesium, barium, iron, ammonium and amine salts. Other suitable secondary anionic surfactants include the alkali metal, ammonium and alkanol ammonium salts of organic sulfuric reaction products having in their molecular structure an alkyl, or alkaryl group containing from 8 to 22 carbon atoms and a sulfonic or sulfuric acid ester group. Examples of such anionic surfactants include water soluble salts of alkyl benzene sulfonates having between 8 and 22 carbon atoms in the alkyl group, alkyl ether sulfates having between 8 and 22 carbon atoms in the alkyl group.

Other anionic surfactants include polyethoxylated alcohol sulfates, such as those sold under the trade name CAL-FOAM® 303 (Pilot Chemical Company, California). Examples of other anionic surfactants are disclosed in U.S. Pat. No. 3,976,586, the disclosure of which is incorporated by reference herein. In another embodiment, the composition is substantially free of additional (secondary) anionic surfactants.

Suitable zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds, such as those disclosed in U.S. Pat. No. 3,929,678, which is incorporated by reference herein.

Other suitable components include organic or inorganic detergency builders. Examples of water-soluble inorganic builders that can be used, either alone or in combination with themselves or with organic alkaline sequestrant builder salts, are glycine, alkyl and alkenyl succinates, alkali metal carbonates, alkali metal bicarbonates, phosphates, polyphosphates and silicates. Specific examples of such salts are sodium tripolyphosphate, sodium carbonate, potassium carbonate, sodium bicarbonate, potassium bicarbonate, sodium pyrophosphate and potassium pyrophosphate. Examples of organic builder salts that can be used alone, or in combination with each other, or with the preceding inorganic alkaline builder salts, are alkali metal polycarboxylates, water-soluble citrates such as sodium and potassium citrate, sodium and potassium tartrate, sodium and potassium ethylenediaminetetracetate, sodium and potassium N(2-hydroxyethyl)-nitrilo triacetates, sodium and potassium N-(2-hydroxyethyl)-nitrilo diacetates, sodium and potassium oxydisuccinates, and sodium and potassium tartrate mono- and di-succinates, such as those described in U.S. Pat. No. 4,663,071, the disclosure of which is incorporated herein by reference.

Suitable biocidal agents include triclosan (5-chloro-2 (2,4-dichloro-phenoxy) phenol)), and the like. Suitable optical brighteners include stilbenes such as TINOPAL® AMS, distyrylbiphenyl derivatives such as TINOPAL® CBS-X, stilbene/naphthotriazole blends such as TINOPAL® RA-16, all sold by Ciba Geigy, oxazole derivatives, and coumarin brighteners.

Suitable enzymes include those known in the art, such as amylolytic, proteolytic, cellulolytic or lipolytic type, and those listed in U.S. Pat. No. 5,958,864, the disclosure of which is incorporated herein by reference. One preferred protease, sold under the trade name SAVINASE® by Novo Nordisk Industries A/S, is a subtillase from *Bacillus lentus*. Other suitable enzymes include proteases, amylases, lipases and cellulases, such as ALCALASE® (bacterial protease), EVERLASE® (protein-engineered variant of SAVINASE®), ESPERASE® (bacterial protease), LIPOLASE® (fungal lipase), LIPOLASE ULTRA (Protein-engineered variant of LIPOLASE), LIPOPRIME® (protein-engineered variant of LIPOLASE), TERMAMYL® (bacterial amylase), BAN (Bacterial Amylase Novo), CELLUZYME® (fungal enzyme), and CAREZYME® (monocomponent cellulase), sold by Novo Nordisk Industries A/S. Also suitable for use in the compositions of the present invention are blends of two or more of these enzymes which are produced by many of these manufacturers, for example a protease/lipase blend, a protease/amylase blend, a protease/amylase/lipase blend, and the like.

Suitable foam stabilizing agents include a polyalkoxylated alkanolamide, amide, amine oxide, betaine, sultaine, $C_8$-$C_{18}$ fatty alcohols, and those disclosed in U.S. Pat. No. 5,616,781, the disclosure of which is incorporated by reference herein. Foam stabilizing agents are used, for example, in amounts of about 1 to about 20, typically about 3 to about 5 percent by weight. The composition can further include an auxiliary foam stabilizing surfactant, such as a fatty acid amide surfactant. Suitable fatty acid amides are $C_8$-$C_{20}$ alkanol amides, monoethanolamides, diethanolamides, and isopropanolamides.

Suitable liquid carriers include water, a mixture of water and a $C_1$-$C_4$ monohydric alcohol (e.g., ethanol, propanol, isopropanol, butanol, and mixtures thereof), and the like. In one embodiment, a liquid carrier comprises from about 90% to about 25% by weight, typically about 80% to about 50% by weight, more typically about 70% to about 60% by weight of the composition. Other suitable components include diluents, dyes and perfumes. Diluents can be inorganic salts, such as sodium and potassium sulfate, ammonium chloride, sodium and potassium chloride, sodium bicarbonate, and the like. Such diluents are typically present at levels of from about 1% to about 10%, preferably from about 2% to about 5% by weight.

Dyes

All dyes suitable for use in dishwashing and/or laundry compositions can be used in the present invention. Suitable such dyes include, but are not limited to chromophore types, e.g., azo, anthraquinone, triarylmethane, methine quinophthalone, azine, oxazine thiazine, which may be of any desired color, hue or shade, including those described elsewhere herein. Suitable dyes can be obtained from any major supplier such as Clariant, Ciba Speciality Chemicals, Dystar, Avecia or Bayer.

Perfumes

The compositions of the invention may optionally include one or more perfumes or fragrances. As used herein, the term "perfume" is used in its ordinary sense to refer to and include any fragrant substance or mixture of substances including natural (obtained by extraction of flowers, herbs, leaves, roots, barks, wood, blossoms or plants), artificial (mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 1% to 70% by weight, the essential oils themselves being volatile odoriferous compounds and also serving to dissolve the other components of the perfume. Suitable perfume ingredients include those disclosed in "Perfume and Flavour Chemicals (Aroma Chemicals)", published by Steffen Arctander (1969), which is incorporated herein by reference. Perfumes can be present from about 0.1% to about 10%, and preferably from about 0.5% to about 5% (weight) of the composition.

Other Optional Ingredients

The compositions may also contain one or more optional ingredients conventionally included in fabric treatment compositions such as pH buffering agents, perfume carriers, fluorescers, colorants, hydrotropes, antifoaming agents, antiredeposition agents, polyelectrolytes, enzymes, optical brightening agents, pearlescers, anti-shrinking agents, anti-wrinkle agents, anti-spotting agents, germicides, fungicides, anti-corrosion agents, drape imparting agents, anti-static agents, ironing aids crystal growth inhibitors, anti-oxidants and anti-reducing agents. Examples and sources of suitable such components are well-known in the art and/or are described herein.

Cleaning System

Thus, in certain aspects, the cleaning system used in the compositions of the present invention comprises a powder phase composition and a gel phase composition, and may further comprise at least one liquid composition. The cleaning system, in two or more matter phases or states (e.g., powder/gel, gel/liquid, powder/gel/liquid, etc.) which may be multi-layered if desired, is contained within a water-soluble single-compartment container. For use, the composition of the invention is placed into an automatic dishwashing or fabric washing machine where, upon contact with water in the machine during the normal wash cycle, the water-soluble container is solubilized thereby releasing the cleaning system contained within the container. According to certain such aspects of the invention, the powder phase composition comprises said at least one detersive surfactant; and said gel phase composition comprises at least one rinse aid polymer, at least one enzyme, at least one catalyst compound suitable for activating a bleaching system or composition, and the like. In other such aspects of the invention, the powder phase composition comprises at least one detersive surfactant and the gel phase composition comprises at least one fabric conditioning compound or composition. According to certain aspects of the invention, the compositions of the invention are formulated so as to be suitable for use in an automatic dishwashing method for removing soils from dishware. In other related aspects, the compositions of the invention are formulated so as to be suitable for use in an automatic laundering method for removing soils from fabrics. According to certain such aspects, the automatic laundering method is performed using a washing machine, a tergetometer or an equivalent device.

Production of Powder

The formulation for the powder used in the compositions of the present invention contains soda ash (white or colored), sodium percarbonate, anionic and/or nonionic surfactants, additional fillers such as sodium sulfate, zeolite, etc. and optionally enzymes, optical brighteners, bleach activators, polymers, etc., performance enhancers. Typical surfactants (also referred to herein as detersive surfactants) suitable for use in the compositions of the present invention include anionic surfactants, nonionic surfactants, zwitterionic surfactants, ampholytic surfactants, cationic surfactants, and the like. Suitable such surfactants are described herein and are known in the art, for example those described in *Surface Active Agents*, Volumes I and II by Schwartz, Perry and Berch (New York, Interscience Publishers); *Nonionic Surfactants*, ed. by M. Schick (New York, M. Dekker, 1967); and in *McCutcheon's Emulsifiers & Detergents* (1989 Annual, M. C. Publishing Co.); the disclosures of which are incorporated herein by reference. Suitable powder formulations for use in the present invention include those comprising sodium carbonate (about 15%-35%, about 20%-35%, about 25%-35%, about 30%-35%, or about 31%-32%); sodium chloride (about 15%-35%, about 20%-35%, about 25%-35%, about 25%-30%, or about 29%-30%); sodium citrate (about 5%-20%, about 10%-20%, about 15%-20%, or about 15%); alcohol alkoxylate (about 1%-5%, about 1%-3%, about 2%-3%, or about 2%-2.5%); acrylic homopolymer(s) (about 1%-5%, about 2%-5%, about 3%-5%, about 3%-4% or about 3%-3.5%); sodium silicate (about 1%-5%, about 2%-5%, about 3%-5%, about 4%-5%, or about 4.5%-5%); water (as absorbed moisture in the other components) (about 2%-5%, about 2%-4%, about 3%-4%, or about 3%-3.5%), sodium percarbonate (about 2.5%-15%, about 5%-15%, about 5%-10%, about 7.5%-10%, about 9%-10%, or about 9%), benzotriazole (about 0.01%-0.1%, about 0.01%-0.05%, about 0.2%-0.5%, or about 0.4%), zinc sulfate (about 0.1%-0.5%, about 0.1%-0.3%, about 0.1%-0.25%, or about 0.25%), dyes (about 0.0001%-0.001%, about 0.0001%-0.00075%, or about 0.0006%), enzymes (e.g., a blend of proteases and amylases, which are commercially available, e.g., from Novozymes A/S (Copenhagen, Denmark) or Danisco/Genencor (Rochester, N.Y.)) (about 0.5%-5%, about 0.75%-5%, about 1%-5%, about 1%-2.5%, or about 1%-1.5%), and fragrance/perfume (about 0.05%-0.5%, about 0.1%-0.2%, or about 0.1%). Exemplary powder formulations suitable for use in the compositions of the present invention include those described in detail in the Examples herein.

Production of Gel

The formulation for the solid-like liquid or gel used in the present compositions can contain a combination of diols, such as propylene glycol, dipropylene glycol, and methylpropylene glycol; any combination thereof and optionally other diols or triols. In addition, the gel phase contains approximately 8.5-65.0% water, preferably 10.0-20.0%, even more preferably 18.0-19.0%. It also contains sodium stearate (or any stearate salt) to create structure. It also optionally contains non-ionic surfactants, polymers as anti-redeposition agents or rinse aids, fragrance, and, most preferably, a dye (or dyes) for aesthetic appeal.

One exemplary composition of the solid gel (any color can be achieved in the gel, depending on the type of dye used) is about 70% to about 80% (e.g., about 76.0%) Dipropylene glycol; about 10% to about 20% (e.g., about 18.0%) Deionized water; about 1% to about 10% (e.g., about 5.0%) Sodium stearate; and about 0.5% to about 5% (e.g., about 1.0%) Dye (added in the form of a 1% aqueous dye solution, i.e., 1% active dye+99% water). This yields a total water content of 18.99%. In practice, a variety of dye colors can be used in the gel, such as blue, yellow, green, orange, purple, clear, etc.

Other exemplary gel formulations suitable for use in the compositions of the present invention are described in the Examples hereinbelow. Liquid formulations suitable for use in the present invention can contain a solubilized formulation of the components described herein for the powder and gel compositions, except in lower concentrations and solubilized in a solvent such as water. Other components suitable for use in the liquid formulations used in the present invention (e.g., rinse aids, bleaching agents, enzymes, catalysts for activating bleaching systems, etc.) are well-known in the art and will be familiar to those of ordinary skill.

In order to make the gel, heating is required. The range of heating is dependent on the levels of dipropylene glycol, water, and sodium stearate. The temperature to which the formulation is heated has to be hot enough to melt the sodium stearate, but not too hot to vaporize the water; hence, changing the composition will change the physical properties. Ideally, the gel is manufactured as a liquid at a temperature of 160-170 degrees Fahrenheit, and most preferably at about 162-164 degrees Fahrenheit. The solid gel forms at a temperature of about 140 degrees F.; the melting and freezing points of the gel are integral to making the compositions of the present invention, as described herein and in particular in Example 1 below.

The majority of the cleaning provided by the compositions of the present invention, whether used in dishwashing or fabric laundering applications, comes from the powder phase which forms the majority of the composition. The ratio of powder and gel in each container (e.g., pouch) can vary depending on aesthetics; however, enough powder is needed to provide ample cleaning. The composition of the pouch can range from about 50% to about 95% powder and from about 5% to about 50% gel, respectively, for a total composition of 100%. Preferably, for ideal cleaning and aesthetic balance, the powder is included at a proportion of about 70% to about 90% and the gel is included at a proportion of about 10% to about 30%, respectively, for a total composition of 100%. Particularly preferred are compositions in which the powder/gel ratio selected from about 90% powder to about 10% gel, about 89% powder to about 11% gel, about 88% powder to about 12% gel, about 87% powder to about 13% gel, about 86% powder to about 14% gel, and about 82% powder to about 18% gel. In certain such preferred embodiments, the powder/gel ratio is about 86% powder to about 14% gel; about 87% powder to about 13% gel; about 88% powder to about 12% gel; about 89% powder to about 11% gel; or about 88.89% powder to about 11.11% gel (i.e., a ratio of about 16 parts powder to about 2 parts gel). Other preferred powder/gel ratios suitably used in preparing the compositions of the present invention will be apparent from the disclosure herein, particularly from the Examples hereinbelow.

Water-Soluble Container

The water soluble container used in the compositions of the present invention is made from a water-soluble material which dissolves, ruptures, disperses, or disintegrates upon contact with water, releasing thereby the composition or cleaning system contained within the container. In preferred, the single-chamber or -compartment sealed water soluble container, which may be in the form of a pouch, is formed from a water soluble polymer. Non-limiting examples of suitable such water soluble polymers include polyvinyl alcohol, cellulose ethers, polyethylene oxide, starch, polyvinylpyrrolidone, polyacrylamide, polyacrylonitrile, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resins, polyethyleneimine, ethyl hydroxyethylcellulose, ethyl methylcellulose, hydroxyethyl methylcellulose, and mixtures thereof. In one embodiment, the water soluble container is made from a lower molecular weight water-soluble polyvinyl alcohol film-forming resin.

Preferred water soluble polymers for forming the pouch are polyvinyl alcohol (PVOH) resins sold under tradename MonoSol® (MonoSol LLC, Ind.). The preferred grade is MonoSol® film having a weight average molecular weight range of about 55,000 to 65,000 and a number average molecular weight range of about 27,000 to 33,000. Preferably, the film material will have a thickness of approximately 3 mil or 75 micrometers. Alternatively, commercial grade PVOH films are suitable for use in the present invention, such as those that are commercially available from Monosol (Merrillville, Ind.) (e.g., Monosol film M8630) or from Aicello (Aiichi, Japan; North American subsidiary in North Vancouver, BC, Canada) (e.g., Aicello fil PT75).

In some embodiments, the water soluble container further comprises a cross-linking agent. In some embodiments, the cross-linking agent is selected from the group consisting of formaldehyde, polyesters, epoxides, isocyanates, vinyl esters, urethanes, polyimides, acrylics with hydroxyl, carboxylic, isocyanate or activated ester groups, bis(methacryloxypropyl)tetramethylsiloxane (styrenes, methylmetacrylates), n-diazopyruvates, phenylboronic acids, cis-platin, divinylbenzene (styrenes, double bonds), polyamides, dialdehydes, triallyl cyanurates, N-(2-ethanesulfonylethyl)pyridinium halides, tetraalkyltitanates, titanates, borates, zireonates, or mixtures thereof. In one embodiment, the cross-linking agent is boric acid or sodium borate.

In additional embodiments, the water-soluble container or film from which it is made can contain one or more additional components, agents or features, such as one or more perfumes or fragrances, one or more enzymes, one or more surfactants, one or more rinse agents, one or more dyes, one or more functional or aesthetic particles, and the like. Such components, agents or features can be incorporate into or on the film when it is manufactured, or are conveniently introduced onto the film during the process of manufacturing the cleaning compositions of the present invention, using methods that are known in the film-producing arts.

In some embodiments, the water soluble container comprises a protective layer between the film polymer and the composition in the pouch. In some embodiments, the protective layer comprises polytetrafluoroethylene (PTFE).

Production of Unit Dose Compositions

The single-compartment, water-soluble container (e.g., pouch) used in the present compositions may be in any desirable shape and size and may be prepared in any suitable way, such as via molding, casting, extruding or blowing, and is then filled using an automated filling process. Examples of processes for producing and filling water-soluble containers, suitable for use in accordance with the present invention, are described in U.S. Pat. Nos. 3,218,776; 3,453,779; 4,776,455; 5,699,653; 5,722,217; 6,037,319; 6,727,215; 6,878,679; 7,259,134; 7,282,472; 7,304,025; 7,329,441; 7,439,215; 7,464,519; and 7,595,290; the disclosures of all of which are incorporated herein by reference in their entireties. In preferred embodiments, the pouches are filled using the cavity filling approach described in U.S. Pat. Nos. 3,218,776 and 4,776,455; machinery necessary for carrying out this process is commercially available, e.g., from Cloud Packaging Solutions (Des Plaines, Ill.; a division of Ryt-way Industries, LLC, Lakeville, Minn.).

The process of using, filling, and cooling the gel are unique and inherent to successfully creating the compositions of the present invention. In certain embodiments, the invention relies at least in part on the fact that a liquid and powder can be combined in a single pouch with minimal migration, by ensuring that the liquid forming the gel instantly freezes upon contact with a cool surface such as the powder or the cavity depending on fill order (both options have been practiced). In practice, if the gel phase is to be shaped or contoured (see, e.g., FIGS. 2*a* and 2*b*, and 4*a* and 4*b*), then it is first filled into a shaped or contoured mold/cavity containing a pouch/container material (such as a PVOH film), allowed to cool to solid form, and the powder then filled in the same container. Alternatively, if the gel phase is to be present in a flat layer, or if multiple gel and powder (and optionally, liquid) layers are to be present in the pouch or container, then the powder can be filled first and the gel layer(s) added on top of the powder layer(s). It is important that if a liquid layer is to be included within the pouch or container, the liquid layer must be separated from any powder layer present in the pouch or container by at least one integral gel solid layer to separate the liquid and powder layers (see, e.g., FIGS. 6*a* and 6*b*).

In order for the gel to be processed realistically, it needs to have a range of low viscosity where it can be used before freezing, which can clog the pump, nozzles, etc. of the processing machinery being used to produce the finished compositions. Thus, in certain embodiments (as shown in the Examples herein, for instance), the principle of hysteresis applies to the liquid-gel formula—it has a higher melting point than freezing point, in that it can be melted to 160° F. in order to be pumped and filled, but does not freeze until about 140° F. so it can tolerate some minor cooling from ambient air and equipment before freezing. Ideally, the gel is filled at about 145° F. to about 155° F., or at about 149° F.-150° F., where it will still be a liquid during fill, but will not migrate into the powder as it freezes instantly upon coming in contact with the powder or cavity which would typically be in the temperature range of about 70° F.-100° F.

Figure 1A:
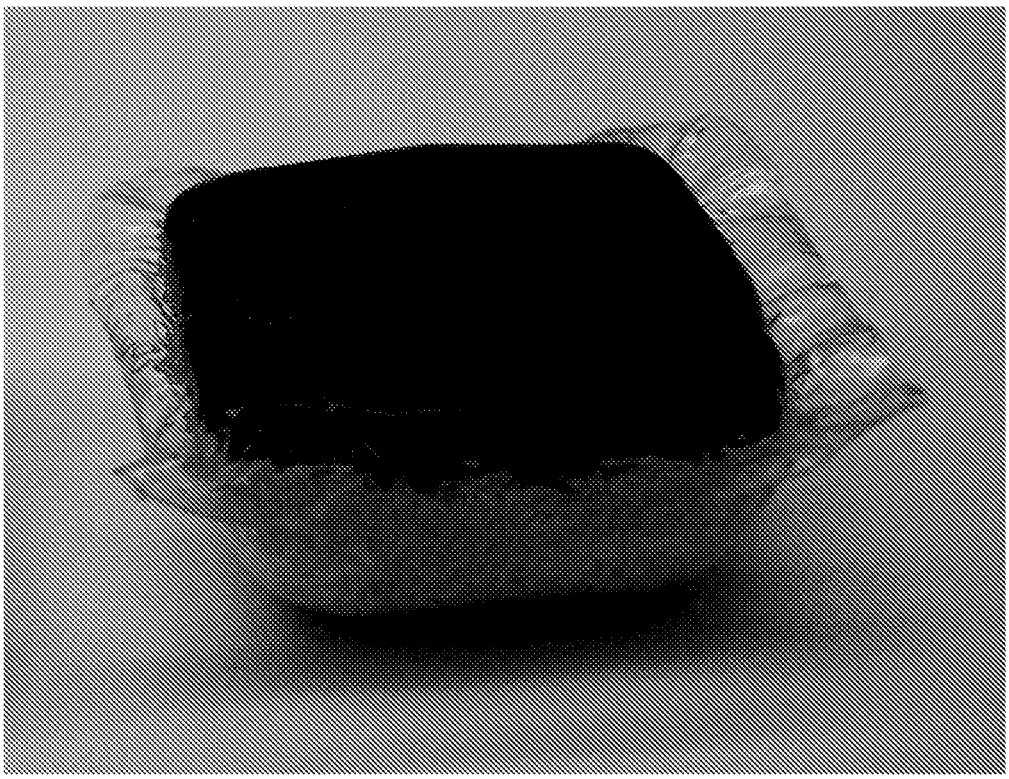
FIGS. 1*a*, 2*a*, 2*b*, 3*a*, 4*a*, 4*b*, and 5*a* are photographs each illustrating an exemplary unit dose detergent composition of the present invention.
Figure 1B:
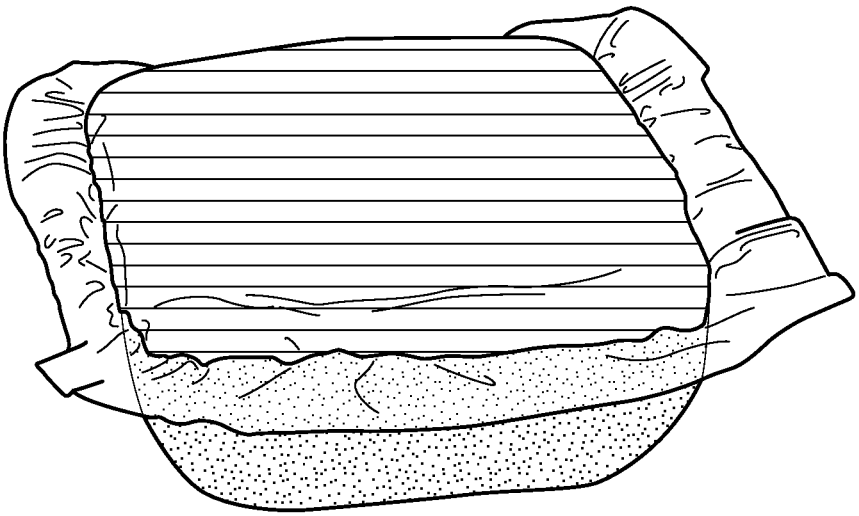
FIGS. 1*b*, 2*c*, 2*d*, 3*b*, 4*c*, 4*d*, and 5*b* are drawings providing black & white line renderings of these photographs.
Figure 2A:
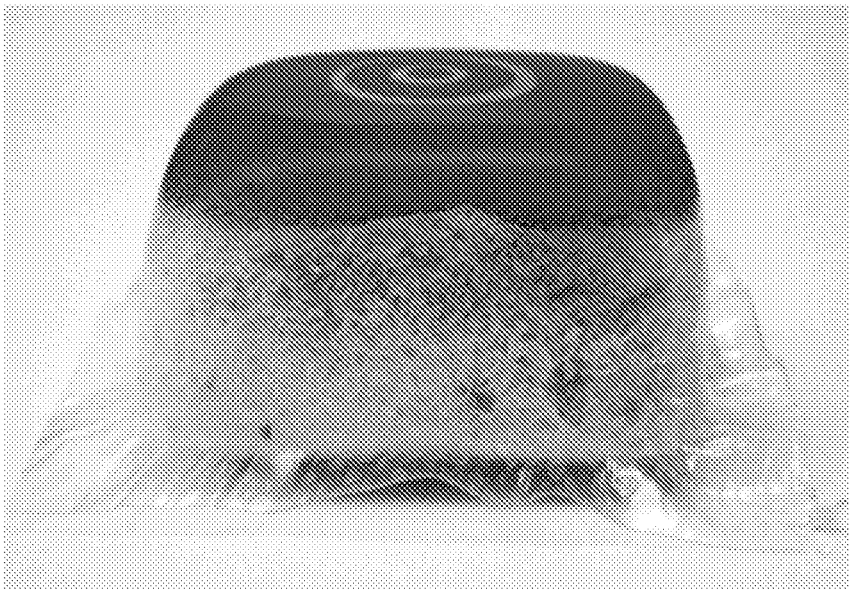
Figure 2B:
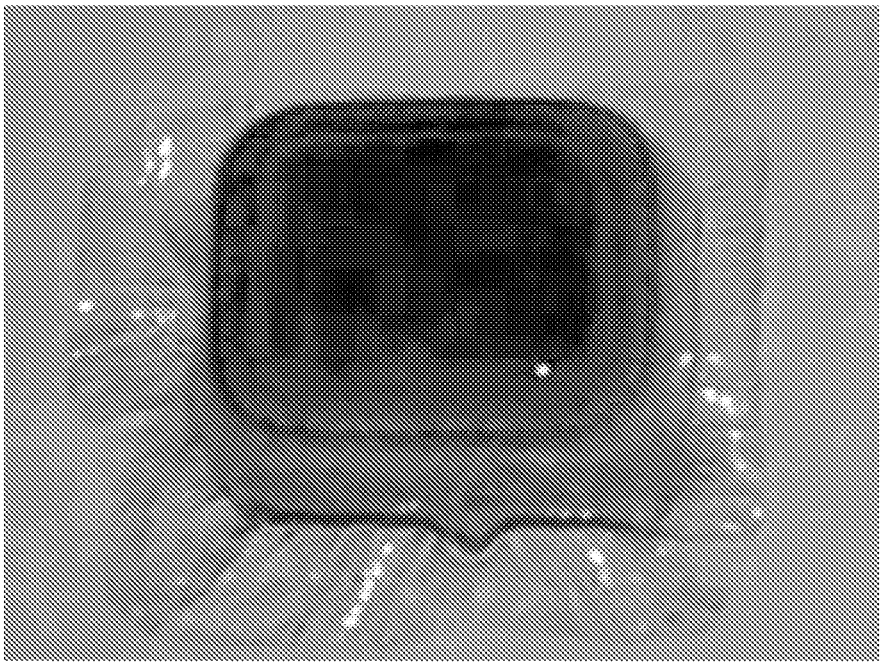
Figure 2C:
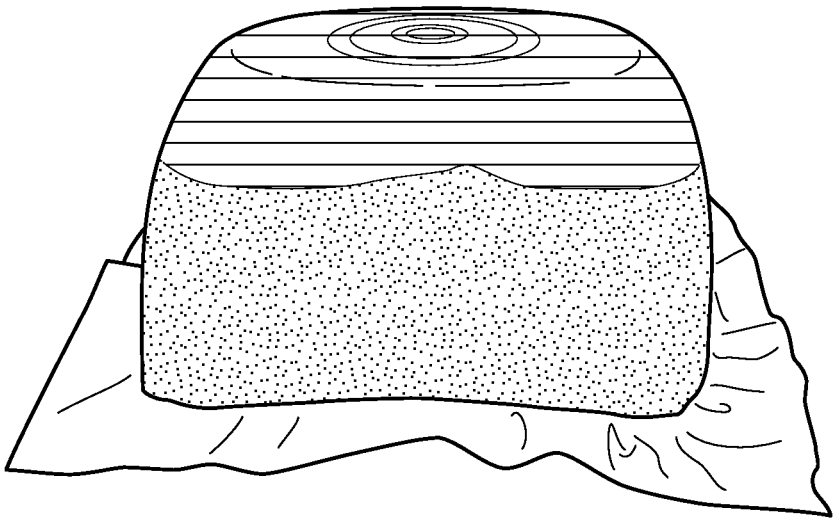
Figure 2D:
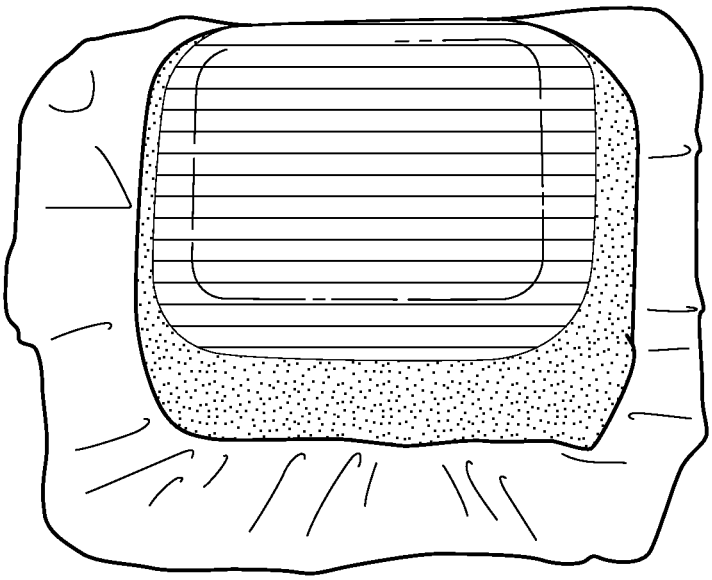
Figure 3A:
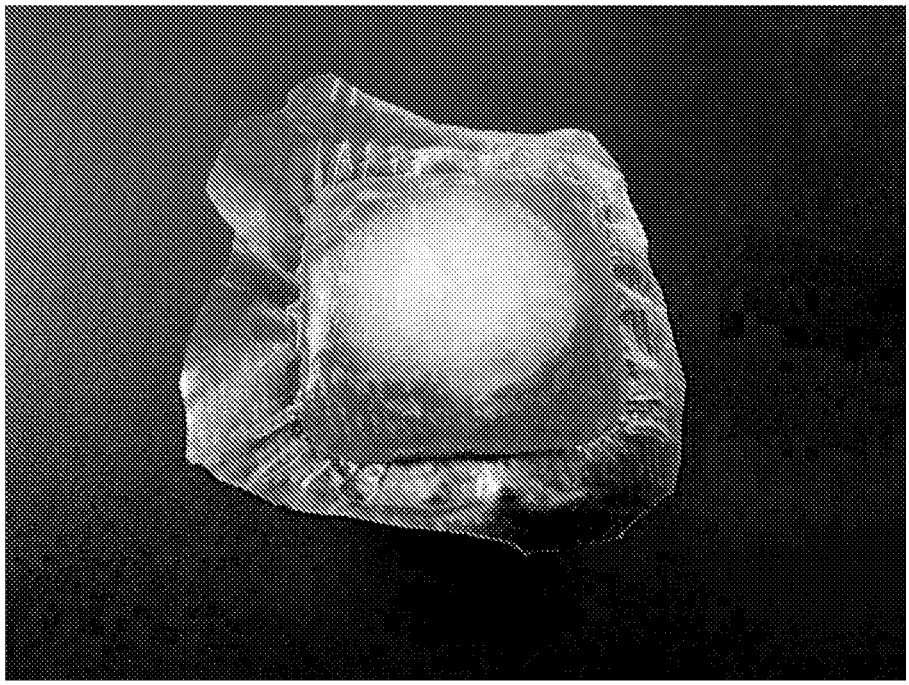
Figure 3B:
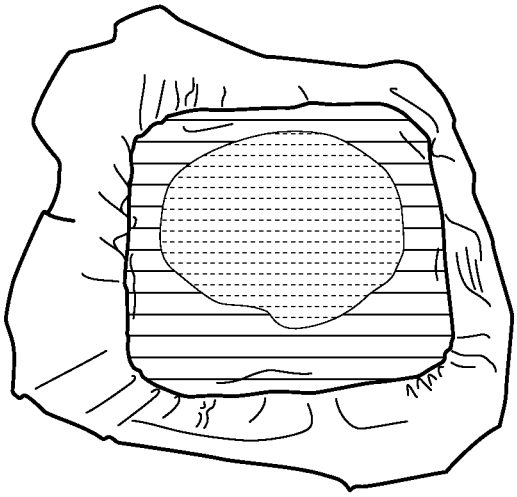
Figure 4A:
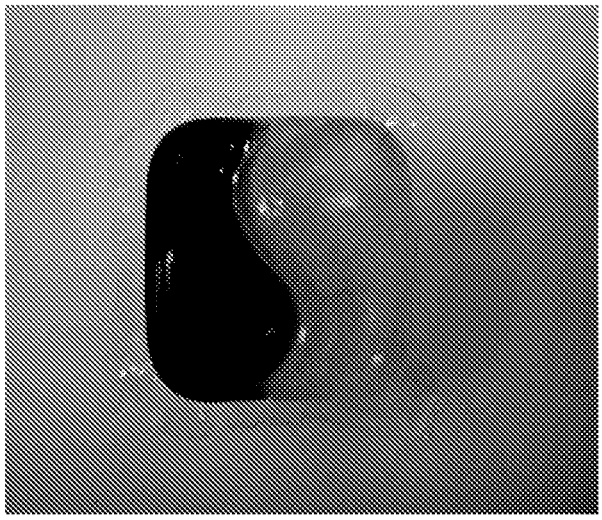
Figure 4B:
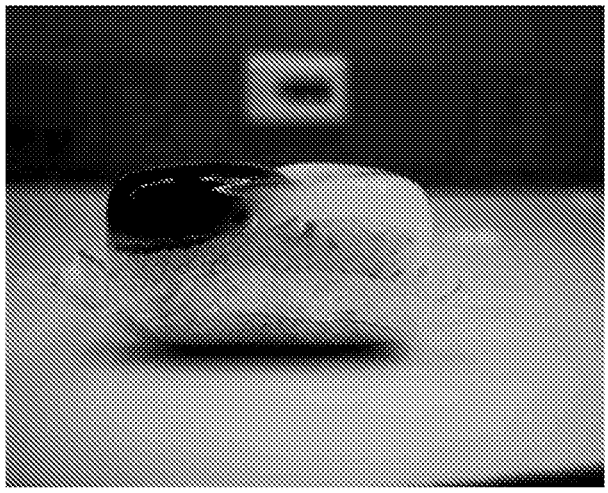
Figure 4C:
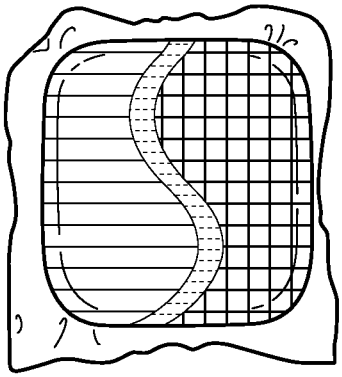
Figure 4D:
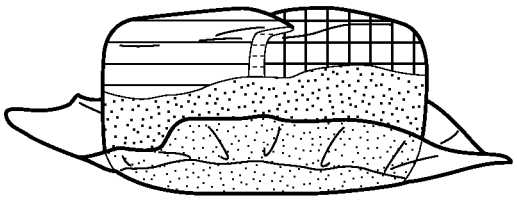

With multiple nozzles and/or multiple filling stations and multiple dyes a variety of shapes and sizes can be achieved. Examples of one-color gel, two-color gel and three-color gel are shown in FIGS. 2*a* (and 2*b*), 3*a*, and 4*a*(and 4*b*), respectively.

In addition, one or more liquid phases can be introduced or layered into the compositions of the present invention, so long as at least one layer of a gel composition is used as a barrier between powder and liquid (see FIGS. 6*a* and 6*b*).

Thus, the present invention provides methods for producing multi-phase unit dose detergent compositions, such as those of the present invention. Suitable such methods comprise, for example: producing at least two different phase form compositions selected from the group consisting of a solid powder phase, a solid gel phase, and a liquid phase, wherein at least one of said at least two different phase form compositions comprises at least one detersive surfactant; providing a single-chamber water-soluble container; sequentially layering said at least two different phase form compositions into said container such that said at least two different phases demonstrate little or no visible intermixing at the interphase between said phases; and sealing said container. In certain such aspects, the methods of the invention allow the production of multi-phase unit dose detergent compositions wherein said at least two different phase form compositions are: at least one powder phase composition and at least one gel phase composition (in which case the multi-phase unit dose detergent composition may further comprise at least one liquid composition); at least one gel phase composition and at least one liquid composition; at least one powder phase composition and at least one liquid composition; and the like. Components that may be suitably contained within the powder phase composition, the solid gel phase composition and/or the liquid phase composition include those described herein, for example for the compositions of the present invention described above. The invention also provides multi-phase unit dose detergent compositions prepared according to such methods, which may be formulated so as to be suitable for use in an automatic dishwashing method for removing soils (such as those soils described above) from dishware or so as to be suitable for use in an automatic laundering method for removing soils (such as those soils described above) from fabrics.

Uses

The present invention also provides methods of removing soils from soiled dishware or soiled fabrics. For example, the invention provides a method of removing In In related aspects, the present invention provides methods of removing soils from soiled dishware or soiled fabrics.

Methods of removing soils from soiled dishware provided by the present invention, for example, comprise: placing said soiled dishware into the chamber of an automatic dishwashing machine that comprises at least one dosing compartment; placing at least one of the single-compartment unit dose compositions of the present invention into said dosing compartment; and introducing water into the chamber of said machine and washing said dishware in an aqueous environment in said machine under conditions favoring the release of the cleaning system into the chamber of said machine such that the components of said cleaning system contact said dishware and remove said soils from said dishware.

In another aspect, the invention provides a method of removing soils from soiled fabrics, comprising: placing said soiled fabrics into the chamber of an automatic fabric-laundering machine, which may be, for example, a washing machine or a tergetometer, or an equivalent device; placing at least one of the single-compartment unit dose compositions of the invention into said fabric-washing machine; and introducing water into the chamber of said machine and washing said fabrics in an aqueous environment in said machine under conditions favoring the release of the cleaning system into the chamber of said machine such that the components of said cleaning system contact said fabrics and remove said soils from said fabrics. In one such aspect of the invention, the single-compartment unit dose composition is placed into the chamber of said fabric-washing machine prior to introducing water into the chamber of said machine. In another such aspect, the single-compartment unit dose composition is placed into the chamber of said fabric-washing machine after introducing water into the chamber of said machine.

Soils that are suitably removed from dishware or fabrics using the compositions and methods of the present invention include, but are not limited to, oil-containing soils, carbohydrate-containing soils, protein-containing soils, tannin-containing soils and particulate soils.

The following examples are illustrative and non-limiting, of the device, products and methods of the present invention. Suitable modifications and adaptations of the variety of conditions, formulations and other parameters normally encountered in the field and which are obvious to those skilled in the art in view of this disclosure are within the spirit and scope of the invention.

EXAMPLES

Example 1

Production of Unit Dose Automatic Dishwashing Compositions

Exemplary unit dose automatic dishwashing compositions of the present invention were prepared by layering powder and gel/liquid detergent formulations and other components sequentially into a pouch container made of polyvinylalcohol. The formulation for the solid-like liquid can contain a combination of diols, such as propylene glycol, dipropylene glycol, and methylpropylene glycol; any combination thereof and optionally other diols or triols. In addition, the liquid contains approximately 8.5-65.0% water, preferably 10.0-20.0%, even more preferably 18.0-19.0%. It also contains sodium stearate (or any stearate salt) to create structure. It also optionally contains non-ionic surfactants, polymers as anti-redeposition agents or rinse aids, fragrance, and, most preferably, a dye (or dyes) for aesthetic appeal. The formulation for the powder contains soda ash (white or colored), sodium percarbonate, anionic and/or nonionic surfactants, additional fillers such as sodium sulfate, zeolite, etc. and optionally enzymes, optical brighteners, bleach activators, polymers, etc., as performance enhancers.

Detergent formulations were prepared as follows:

A. Powder Formulation:

| Ingredient | % in formulation (nominal) Example 1a | Example 1b |
|---|---|---|
| Sodium Carbonate | 31.2656 | 31.2656 |
| Sodium Chloride | 29.5000 | 23.8900 |
| Sodium Citrate | 15.0000 | 15.0000 |
| Alcohol Alkoxylate | 2.1600 | 4.1600 |
| Acrylic Homopolymer | 3.2500 | 3.3600 |
| Sodium Silicate | 4.8900 | 2.3600 |
| Water/Moisture Content | 3.3438 | 4.3238 |
| Sodium Percarbonate | 9.0000 | 13.7500 |
| Benzotriazole | 0.0400 | 0.0400 |
| Zinc Sulfate | 0.2500 | 0.2500 |
| Dye | 0.0006 | 0.0006 |
| Protease/Amylase blend | 1.2000 | 1.5000 |
| Perfume | 0.1000 | 0.1000 |
| Total | 100.0000 | 100.0000 |

B. Gel Formulation:

| Ingredient | % in formulation (nominal) Example 1a | Example 1b | Order of Addition |
|---|---|---|---|
| Dipropylene Glycol | 76.00 | 76.00 | 1 |
| Deionized water | 18.99 | 18.97 | 2 |
| Sodium Stearate | 5.00 | 5.00 | 3 |
| Dye | 0.01 | 0.03 | 4 |
| Total | 100.00 | 100.00 | — |

This yields a total water content of about 19%. In practice, the colors used have been blue, yellow, orange, turquoise, and clear, although any gel color is suitably used in the present compositions. In order to make the gel, heating is required. The range of heating is dependent on the levels of DIPG, water, and sodium stearate. It has to be hot enough to melt the sodium stearate, but not too hot to vaporize the water; hence, changing the composition changes the physical properties. Ideally, the gel is manufactured as a liquid at a temperature of 160-170 degrees Fahrenheit and most preferably at 162 degrees Fahrenheit. The solid gel forms at a temperature of about 140 degrees F.; the melting and freezing points of the gel are integral to making the compositions of the present invention, as described elsewhere herein.

To produce gel, dipropylene glycol and deionized water were admixed at room temperature, and heated to 162° F. This temperature was found to be necessary to ensure complete dissolution of all components, and was maintained as further components were added. Sodium stearate was then added and the mixture was stirred until most or all of the sodium stearate was solubilized (the mixture turned a light yellow color when this occurred). Dye was then added at 1% of a 1% solution in water, and the solution mixed to achieve a uniform color. Deionized water was then added to make final volume. The mixture was found to solidify to a gel when cooled to about 140° F., although a temperature below about 150° F. was sufficient to ensure that the gel component did not penetrate into the powder when layered into the pouch with powder (about 150° F., for example at 156° F., the gel formulation was found to migrate into the powder layer which is an undesirable result).

The above foregoing formulations were filled into pouches that were heat-formed in manufacturing molds. Pouches were made of polyvinylalcohol (PVOH) film such as MonoSol M8630 (Monosol, Inc.; Merrillville, Ind.) or Aicello PT75 (Aicello North America, Inc., North Vancouver, BC, Canada) having a film thickness of about 3 mil or 75 micrometers. Powder and gel were added sequentially to the PVOH pouch, with the order depending upon whether or not the gel is to be shaped or contoured (gel was placed into the PVOH pouch first, in a contoured or shaped mold cavity, if the gel was to be shaped or contoured; powder was placed into the PVOH pouch first if the gel was to be a flat layer). Powder and gel were combined in various ratios as described herein, for example in the ratios described in Examples 2-4 hereinbelow, and then sealed according to art-known procedures for sealing PVOH film containers, to obtain unit dose gel-powder automatic dishwashing formulations in PVOH pouches.

For use, a single unit dose pouch was introduced into the dosing compartment of an automatic dishwashing machine (or equivalent instrument) prior to starting the cleaning cycle (for cleaning of heavily soiled dishware, if desired, two unit dose pouches could be added to the dosing compartment if the machine has a dual-chambered dosing compartment). Soiled dishware was then added to the machine, and the machine was set to desired cleaning cycle depending upon types of dishware to be washed, degree of soiling, etc., according to parameters that will be familiar to the ordinarily skilled artisan and to the average end-user of commercially available dishwashing formulations. Following the dishwashing cycle, dishware was inspected and the unit dose compositions of the present invention were found to be suitable for cleaning a variety of typically encountered household and industrial (e.g., restaurant) dishware soils.

Example 2

90%/10% Unit Dose Automatic Dishwashing Compositions

An exemplary unit dose automatic dishwashing composition of the present invention was prepared by layering powder and gel detergent formulations produced as described in Example 1 above sequentially into a pouch container made of polyvinylalcohol. Formulations were added to the pouch to arrive at an end product containing 90% powder and 10% gel. For example, for a unit dose pouch product containing 20 grams of total formulation, each pouch contained 18 grams of powder and 2 grams of solid gel. Each finished pouch composition therefore contained the following components:

| Ingredient | % in formulation (nominal) |
|---|---|
| Dipropylene Glycol | 7.60000 |
| Deionized water | 4.90842 |
| Sodium Stearate | 0.50000 |
| Dye for gel | 0.00100 |
| Sodium Carbonate | 28.13904 |
| Sodium Chloride | 26.55000 |
| Sodium Citrate | 13.50000 |
| Alcohol Alkoxylate | 1.94400 |
| Acrylic Homopolymer | 2.92500 |
| Sodium Silicate | 4.40100 |
| Sodium Percarbonate | 8.10000 |
| Benzotriazole | 0.03600 |
| Zinc Sulfate | 0.22500 |
| Dye for powder | 0.00054 |

-continued

| Ingredient | % in formulation (nominal) |
|---|---|
| Protease/Amylase blend | 1.08000 |
| Perfume | 0.09000 |
| Total | 100.0000 |

Example 3

86%114% Unit Dose Automatic Dishwashing Compositions

An exemplary unit dose automatic dishwashing composition of the present invention was prepared by layering powder and gel detergent formulations produced as described in Example 1 above sequentially into a pouch container made of polyvinylalcohol. Formulations were added to the pouch to arrive at an end product containing 86% powder and 14% gel. For example, for a unit dose pouch product containing 21 grams of total formulation, each pouch contained 18 grams of powder and 3 grams of solid gel. Each finished pouch composition therefore contained the following components:

| Ingredient | % in formulation (nominal) |
|---|---|
| Dipropylene Glycol | 10.85714 |
| Deionized water | 5.57897 |
| Sodium Stearate | 0.71429 |
| Dye for gel | 0.00143 |
| Sodium Carbonate | 26.79909 |
| Sodium Chloride | 25.28571 |
| Sodium Citrate | 12.85714 |
| Alcohol Alkoxylate | 1.85143 |
| Acrylic Homopolymer | 2.78571 |
| Sodium Silicate | 4.19143 |
| Sodium Percarbonate | 7.71429 |
| Benzotriazole | 0.03429 |
| Zinc Sulfate | 0.21429 |
| Dye for powder | 0.00051 |
| Protease/Amylase blend | 1.02857 |
| Perfume | 0.08571 |
| Total | 100.0000 |

Example 4

82%/18% Unit Dose Automatic Dishwashing Compositions

An exemplary unit dose automatic dishwashing composition of the present invention was prepared by layering powder and gel detergent formulations produced as described in Example 1 above sequentially into a pouch container made of polyvinylalcohol. Formulations were added to the pouch to arrive at an end product containing 82% powder and 18% gel. For example, for a unit dose pouch product containing 22 grams of total formulation, each pouch contained 18 grams of powder and 4 grams of solid gel. Each finished pouch composition therefore contained the following components:

| Ingredient | % in formulation (nominal) |
|---|---|
| Dipropylene Glycol | 13.8182 |
| Deionized water | 6.1885 |

-continued

| Ingredient | % in formulation (nominal) |
|---|---|
| Sodium Stearate | 0.9091 |
| Dye for gel | 0.0018 |
| Sodium Carbonate | 25.5809 |
| Sodium Chloride | 24.1364 |
| Sodium Citrate | 12.2727 |
| Alcohol Alkoxylate | 1.7673 |
| Acrylic Homopolymer | 2.6591 |
| Sodium Silicate | 4.0009 |
| Sodium Percarbonate | 7.3636 |
| Benzotriazole | 0.0327 |
| Zinc Sulfate | 0.2045 |
| Dye for powder | 0.0005 |
| Protease/Amylase blend | 0.9818 |
| Perfume | 0.0818 |
| Total | 100.0000 |

Example 5

88.89%41.11% Unit Dose Automatic Dishwashing Compositions

An exemplary unit dose automatic dishwashing composition of the present invention was prepared by layering powder and gel detergent formulations produced as described in Example 1 above sequentially into a pouch container made of polyvinylalcohol. Formulations were added to the pouch to arrive at an end product containing 88.89% powder and 11.11% gel. For example, for a unit dose pouch product containing 18 grams of total formulation, each pouch contained 16 grams of powder and 2 grams of solid gel. Each finished pouch composition therefore contained the following components:

| Ingredient | % in formulation (nominal) |
|---|---|
| Dipropylene Glycol | 8.44360 |
| Deionized water | 5.95099 |
| Sodium Stearate | 0.55550 |
| Dye for gel | 0.00333 |
| Sodium Carbonate | 27.79199 |
| Sodium Chloride | 21.23582 |
| Sodium Citrate | 13.33350 |
| Alcohol Alkoxylate | 3.69782 |
| Acrylic Homopolymer | 2.98670 |
| Sodium Silicate | 2.09780 |
| Sodium Percarbonate | 12.22238 |
| Benzotriazole | 0.03556 |
| Zinc Sulfate | 0.22223 |
| Dye for powder | 0.00053 |
| Protease/Amylase blend | 1.33335 |
| Perfume | 0.08889 |
| Total | 100.0000 |

Example 6

Unit Dose Laundry Compositions

Exemplary unit dose laundry compositions of the present invention were prepared by layering powder and gel/liquid detergent formulations and other components sequentially into a pouch container made of polyvinylalcohol. Detergent formulations were prepared as follows:

A. Powder Formulation:

| Ingredient | % in formulation (nominal) |
|---|---|
| Sodium Chloride | 14.53700 |
| $C_{12}$ linear alkylbenzene sulfonate (LAS) | 6.71850 |
| $C_{12-14}$ LAE ethoxylation degree = 9 | 0.07125 |
| Water/Moisture Content | 1.69580 |
| Sodium Polyacrylate | 1.30485 |
| Sodium Silicate | 3.48740 |
| Sodium Carbonate | 26.35075 |
| Optical Brightener | 0.32655 |
| $C_{12-18}$ Methylester Sulfonate (MES) | 30.0000 |
| Protease | 2.25000 |
| Sodium Percarbonate | 2.25000 |
| Blue Speckle | 10.0000 |
| Fragrance | 0.46000 |
| Carboxymethylcellulose 72% | 0.54790 |
| Total | 100.00000 |

B. Gel Formulation:

The gel formulation used for the laundry unit dose detergent products produced in this Example was the same as that described above for Example 1.

Powder and gel were added sequentially to the PVOH pouch, with the order depending upon whether or not the gel is to be shaped or contoured (gel was placed into the PVOH pouch first, in a contoured or shaped mold cavity, if the gel was to be shaped or contoured; powder was placed into the PVOH pouch first if the gel was to be a flat layer). Powder and gel were combined in ratios as described herein; in the exemplary compositions described in this example, each pouch was filled to contain about 87% powder and about 13% gel.

Alternative unit dose laundry compositions according to the invention may comprise one or more additional or alternative formulations in the gel phase, for example one or more fabric conditioning or softening compositions, one or more bleaching compositions, one or more stain booster compositions, one or more water softening compositions, one or more whitening compositions, and the like. Suitable such compositions and methods for formulating them into gels for use in the present invention will be familiar to those of ordinary skill based on information available in the art and the disclosure contained herein.

Example 7

Performance of Unit Dose Dish Detergent Compositions

Unit dose dish detergent compositions of the present invention were produced according to the methods described in Examples 1-5 herein. These compositions were tested against certain commercially available unit dose dish detergent compositions, to determine the ability of the compositions to remove stuck-on egg residue from metal plates. To perform the test, aluminum alloy plates were coated with raw scrambled egg liquid, and the liquid allowed to dry on the plates. The plates were then baked in an oven for approximately 30 mins at 350° F. The plates were then individually placed into a separate domestic automatic dishwashing machine, and each washing machine was dosed with one of the composition of the present invention, or with a commercially available composition. Control machines received no detergent composition. Plates were then washed in a standard wash-rinse cycle in the dishwashing machines, and the plates allowed to airdry before being photographed for examination of residual egg soil. Results are shown in FIGS. 8*a*-8*e*

Figure 8A:
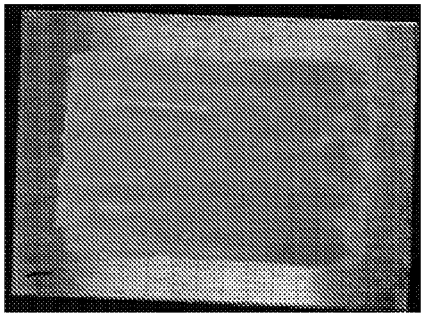
FIGS. 8*a*-8*e* are photographs of metal plates coated with stuck-on egg residue and washed in a domestic automatic dishwasher in the absence of any detergent (control.
Figure 8B:
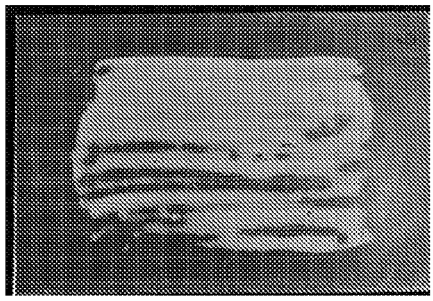
Figure 8C:
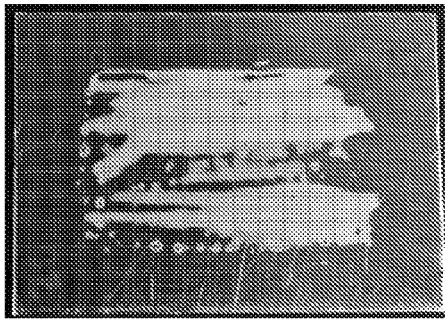
Figure 8D:
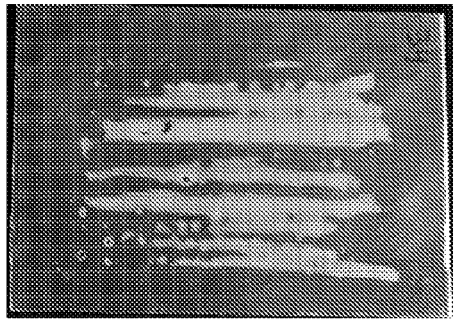
Figure 8E:
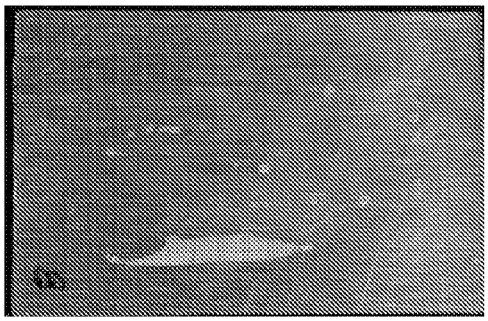

As shown in FIGS. 8*a*-8*e* the compositions of the present invention (FIG. 8*e*) outperformed all commercial compositions tested (FIGS. 8*b*-8*d*), in that less egg residue remained on the plate washed with the composition of the present invention compared to the other compositions tested, vs. control (no detergent) washing (FIG. 8*a*).

Having now fully described this invention, it will be understood by those of ordinary skill in the art that the same can be performed within a wide and equivalent range of conditions, formulations and other parameters without affecting the scope of the invention or any embodiment thereof.

Other embodiments of the invention will be apparent to those skilled in the art from consideration of the specification and practice of the invention disclosed herein. It is intended that the specification and examples be considered as exemplary only, with a true scope and spirit of the invention being indicated by the following claim.

What is claimed is:

1. A multi-phase unit dose detergent composition, comprising:

a water-soluble single-chamber container defining a single compartment; and a cleaning system comprising at least two different phases selected from the group consisting of a solid powder phase, a solid gel phase, and a liquid phase, wherein said cleaning system comprises at least one detersive surfactant, said cleaning system is contained in said compartment defined by said container, and said at least two different phases each form different layers that are in direct contact with each other and demonstrate little or no visible intermixing at the interphase between said phases.

2. The composition of claim 1, wherein said single-chamber container is a formed, sealed pouch produced from a water-soluble polymer or film.

3. The composition of claim 2, wherein said single-chamber pouch is produced from a polyvinylalcohol (PVOH) film.

4. The composition of claim 1, wherein said cleaning system comprises at least one powder phase composition and at least one gel phase composition.

5. The composition of claim 4, wherein said composition comprises a powder/gel ratio selected from the group consisting of about 90% powder to about 10% gel, about 89% powder to about 11% gel, about 88% powder to about 12% gel, about 87% powder to about 13% gel, about 86% powder to about 14% gel, and about 82% powder to about 18% gel.

6. The composition of claim 4, wherein said multi-phase unit dose detergent composition comprises a powder/gel ratio of about 86% powder to about 14% gel.

7. The composition of claim 4, wherein said multi-phase unit dose detergent composition comprises a powder/gel ratio of about 87% powder to about 13% gel.

8. The composition of claim 4, wherein said multi-phase unit dose detergent composition comprises a powder/gel ratio of about 88% powder to about 12% gel.

9. The composition of claim 4, wherein said multi-phase unit dose detergent composition comprises a powder/gel ratio of 89% powder to about 11% gel.

10. The composition of claim 4, wherein said multi-phase unit dose detergent composition comprises a powder/gel ratio of about 88.89% powder to about 11.11% gel.

11. The composition of claim 4, wherein said gel phase composition comprises from about 70% to about 80% dipropylene glycol, from about 10% to about 20% water, and from about 1% to about 10% sodium stearate.

12. The composition of claim 4, wherein said gel phase comprises about 76% dipropylene glycol, about 18% water, and about 5% sodium stearate.

13. The composition of claim 4, wherein said cleaning system further comprises at least one liquid composition.

14. The composition of claim 4, wherein said powder phase composition comprises said at least one detersive surfactant and said gel phase composition comprises at least one rinse aid polymer.

15. The composition of claim 4, wherein said powder phase composition comprises said at least one detersive surfactant and said gel phase composition comprises at least one enzyme.

16. The composition of claim 4, wherein said powder phase composition comprises said at least one detersive surfactant and said gel phase composition comprises at least one catalyst compound suitable for activating a bleaching system or composition.

17. The composition of claim 4, wherein said powder phase composition comprises at least one detersive surfactant and said gel phase composition comprises at least one fabric conditioning compound or composition.

18. The composition of claim 1, wherein said at least one detersive surfactant is selected from the group consisting of anionic surfactants, nonionic surfactants, zwitterionic surfactants, ampholytic surfactants and cationic surfactants.

19. The composition of claim 18, wherein said at least one detersive surfactant is an alkylene sulfofatty acid salt.

20. The composition of claim 19, wherein said alkylene sulfofatty acid salt is a methylester sulfonate of a fatty acid.

21. The composition of claim 1, wherein said composition is formulated so as to be suitable for use in an automatic dishwashing method for removing soils from dishware.

22. The composition of claim 1, wherein said composition is formulated so as to be suitable for use in an automatic laundering method for removing soils from fabrics.

23. The composition of claim 22, wherein said automatic laundering method is performed using a washing machine, a tergetometer or an equivalent device.

24. The composition of claim 21, wherein said soils are selected from the group consisting of oil-containing soils, carbohydrate-containing soils, protein-containing soils, tannin-containing soils and particulate soils.

25. A method of removing soils from soiled dishware, comprising:

placing said soiled dishware into the chamber of an automatic dishwashing machine that comprises at least one dosing compartment;

placing at least one of the single-compartment unit dose compositions of claim 1 into said dosing compartment; and introducing water into the chamber of said machine and washing said dishware in an aqueous environment in said machine under conditions favoring the release of the cleaning system into the chamber of said machine such that the components of said cleaning system contact said dishware and remove said soils from said dishware.

26. The method of claim 25, wherein said soils are selected from the group consisting of oil-containing soils, carbohydrate-containing soils, protein-containing soils, tannin-containing soils and particulate soils.

27. A method of removing soils from soiled fabrics, comprising:

placing said soiled fabrics into the chamber of an automatic fabric-laundering machine;

placing at least one of the single-compartment unit dose compositions of claim 1 into said fabric-washing machine; and introducing water into the chamber of said machine and washing said fabrics in an aqueous environment in said machine under conditions favoring the release of the cleaning system into the chamber of said machine such that the components of said cleaning system contact said fabrics and remove said soils from said fabrics.

28. The method of claim 27, wherein said single-compartment unit dose composition is placed into the chamber of said fabric-washing machine prior to introducing water into the chamber of said machine.

29. The method of claim 27, wherein said single-compartment unit dose composition is placed into the chamber of said fabric-washing machine after introducing water into the chamber of said machine.

30. The method of claim 27, wherein said soils are selected from the group consisting of oil-containing soils, carbohydrate-containing soils, protein-containing soils, tannin-containing soils and particulate soils.

31. The method of claim 27, wherein said automatic fabric-laundering machine is a washing machine, a tergetometer or an equivalent device.

32. A method for producing a multi-phase unit dose detergent composition, comprising:

producing at least two different phase form compositions selected from the group consisting of a solid powder phase, a solid gel phase, and a liquid phase, wherein at least one of said at least two different phase form compositions comprises at least one detersive surfactant;

providing a single-chamber water-soluble container defining a single compartment;

sequentially layering said at least two different phase form compositions into said single compartment of said container such that said at least two different phases each form different layers that are in direct contact with each other, and demonstrate little or no visible intermixing at the interphase between said phases; and sealing said container.

33. A multi-phase unit dose detergent composition produced according to the method of claim 32.

34. The composition of claim 22, wherein said soils are selected from the group consisting of oil-containing soils, carbohydrate-containing soils, protein-containing soils, tannin-containing soils and particulate soils.

* * * * *